US012486648B2

(12) United States Patent
Sano

(10) Patent No.: US 12,486,648 B2
(45) Date of Patent: Dec. 2, 2025

(54) SHOVEL AND SHOVEL MANAGEMENT APPARATUS

(71) Applicant: SUMITOMO HEAVY INDUSTRIES, LTD., Tokyo (JP)

(72) Inventor: Yusuke Sano, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 286 days.

(21) Appl. No.: 17/448,424

(22) Filed: Sep. 22, 2021

(65) Prior Publication Data

US 2022/0002979 A1 Jan. 6, 2022

Related U.S. Application Data

(63) Continuation of application No. PCT/JP2020/014051, filed on Mar. 27, 2020.

(30) Foreign Application Priority Data

Mar. 27, 2019 (JP) ..... 2019-060866

(51) Int. Cl.
*E02F 9/26* (2006.01)
*E02F 9/28* (2006.01)

(52) U.S. Cl.
CPC ..... *E02F 9/267* (2013.01); *E02F 9/2883* (2013.01)

(58) Field of Classification Search
CPC ..... E02F 9/267; E02F 9/2883
See application file for complete search history.

(56) References Cited

U.S. PATENT DOCUMENTS

| | | | | |
|---|---|---|---|---|
| 5,446,980 | A * | 9/1995 | Rocke | E02F 3/439 701/50 |
| 6,247,538 | B1 * | 6/2001 | Takeda | G05D 1/0234 37/348 |
| 9,988,794 | B2 | 6/2018 | Miura et al. | |
| 10,557,249 | B2 | 2/2020 | Tsuji | |
| 2016/0091002 | A1 * | 3/2016 | Miura | E02F 3/96 60/459 |
| 2017/0175362 | A1 * | 6/2017 | Iwanaga | G01S 19/43 |
| 2017/0255895 | A1 | 9/2017 | Kozumi et al. | |
| 2018/0135273 | A1 * | 5/2018 | Tsuji | E02F 3/434 |

FOREIGN PATENT DOCUMENTS

| | | |
|---|---|---|
| JP | 3224066 | 10/2001 |
| JP | 2011-231489 | 11/2011 |
| JP | 2013-113044 | 6/2013 |
| JP | 2016-070004 | 5/2016 |

(Continued)

OTHER PUBLICATIONS

International Search Report for PCT/JP2020/014051 mailed on Jun. 9, 2020.

*Primary Examiner* — Andrew J Cromer
(74) *Attorney, Agent, or Firm* — IPUSA, PLLC

(57) ABSTRACT

A shovel includes a lower traveling structure, an upper swing structure swingably mounted on the lower traveling structure, an attachment attached to the upper swing structure and including a bucket, and processing circuitry. The processing circuitry is configured to set a shape parameter of the bucket according to a bucket shape obtained in advance. The bucket shape represents the shape of the bucket.

15 Claims, 18 Drawing Sheets

(56) References Cited

FOREIGN PATENT DOCUMENTS

| | | |
|---|---|---|
| JP | 2017-043885 | 3/2017 |
| JP | 2017-157016 | 9/2017 |
| WO | 2015/030266 | 3/2015 |
| WO | 2015/162710 | 10/2015 |
| WO | 2016/125915 | 8/2016 |

* cited by examiner

SHOVEL AND SHOVEL MANAGEMENT APPARATUS

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/014051, filed on Mar. 27, 2020 and designating the U.S., which is based upon and claims priority to Japanese Patent Application No. 2019-060866, filed on Mar. 27, 2019. The entire contents of the foregoing applications are incorporated herein by reference.

BACKGROUND

Technical Field

The present disclosure relates to shovels and shovel management apparatuses.

Description of Related Art

A shovel equipped with a construction machine monitoring system that presents an image to enable an operator to intuitively understand the state of the attachment of a construction machine is known. According to such a shovel, buckets of various shapes are employed, and when the attached bucket is replaced, the operator manually changes settings according to a newly attached bucket.

SUMMARY

According to an aspect of the present invention, a shovel includes a lower traveling structure, an upper swing structure swingably mounted on the lower traveling structure, an attachment attached to the upper swing structure and including a bucket, and processing circuitry. The processing circuitry is configured to set a shape parameter of the bucket according to a bucket shape obtained in advance. The bucket shape represents the shape of the bucket.

DETAILED DESCRIPTION

Figure 1:
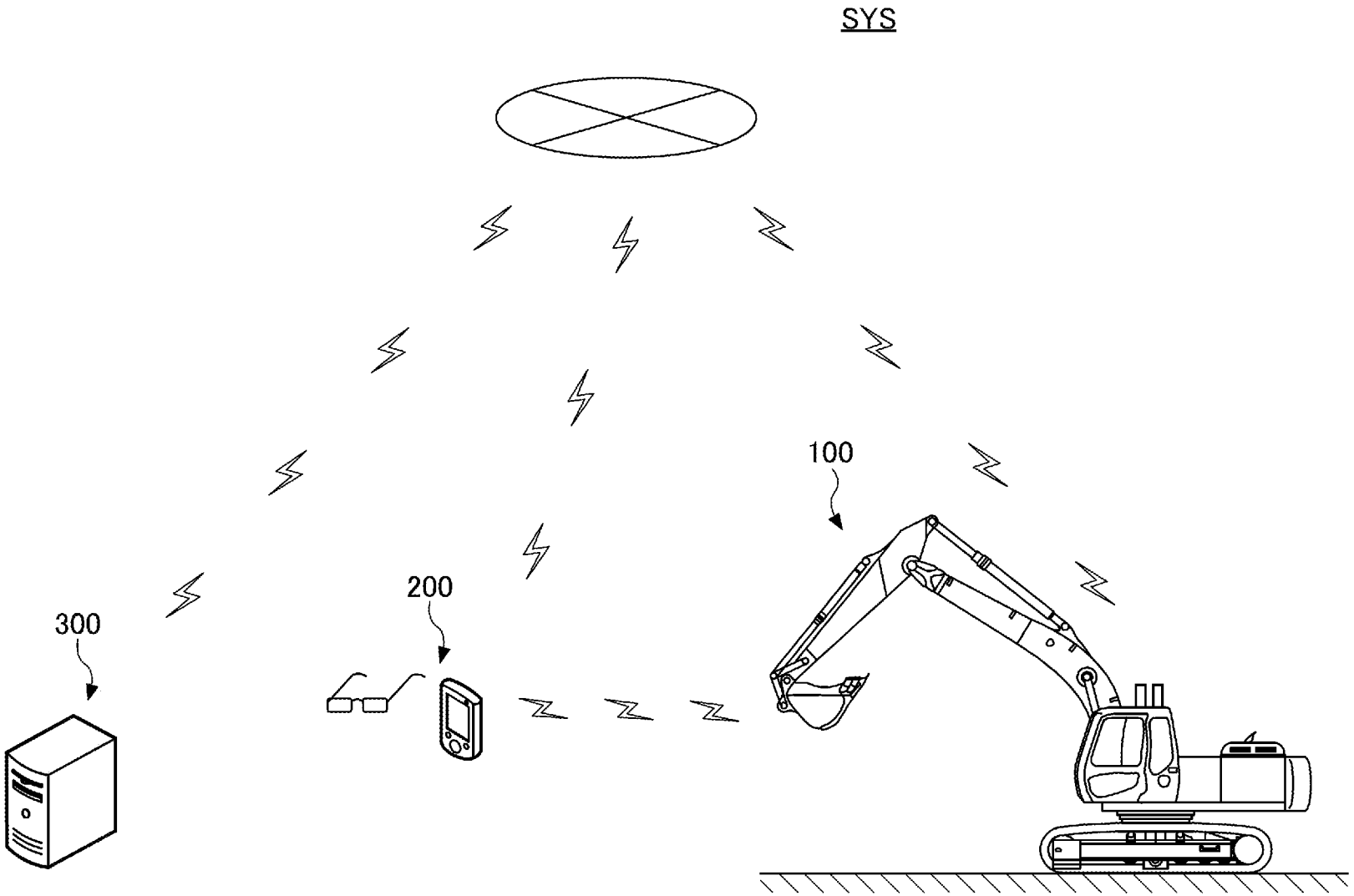
FIG. 1 is a schematic diagram illustrating an example configuration of a work support system.

Manually changing settings when changing buckets as described above, however, takes time and effort.

Therefore, it is desired to provide a shovel and a shovel management system that facilitate changing settings when changing buckets.

According to an aspect of the present disclosure, a shovel and a shovel management system that facilitate changing settings when changing buckets are provided.

A non-limiting embodiment according to the present disclosure is described below with reference to the accompanying drawings. In the following description, the same or corresponding elements are referred to using the same reference numerals, and a duplicate description thereof is omitted.

First, a work support system SYS including a work assist device 200 for a shovel 100 according to this embodiment is described with reference to FIG. 1. FIG. 1 is a diagram illustrating an example configuration of the work support system SYS.

The work support system SYS is a system that supports work related to the shovel 100. The work related to the shovel 100 includes the work of replacing a component of the shovel 100, the work of identifying the cause of a failure of the shovel 100, and work related to repair after identifying the cause. According to this embodiment, the work support system SYS includes the shovel 100, the work assist device 200, and a management apparatus 300. The number of shovels 100, the number of work assist devices 200, and the number of management apparatuses 300 included in the work support system SYS may be one or more. According to this embodiment, the work support system SYS includes the single shovel 100, the single work assist device 200, and the single management apparatus 300.

The work assist device 200 is a portable terminal device. Examples of the work assist device 200 include a tablet PC, a smartphone, a wearable PC, smartglasses or the like carried by a worker or the like at a worksite.

The management apparatus 300 is a stationary terminal apparatus such as a management server. Examples of the management apparatus 300 include a computer installed in a management center or the like outside a worksite and portable computers such as notebook PCs, tablet PCs, and smartphones.

Figure 2:
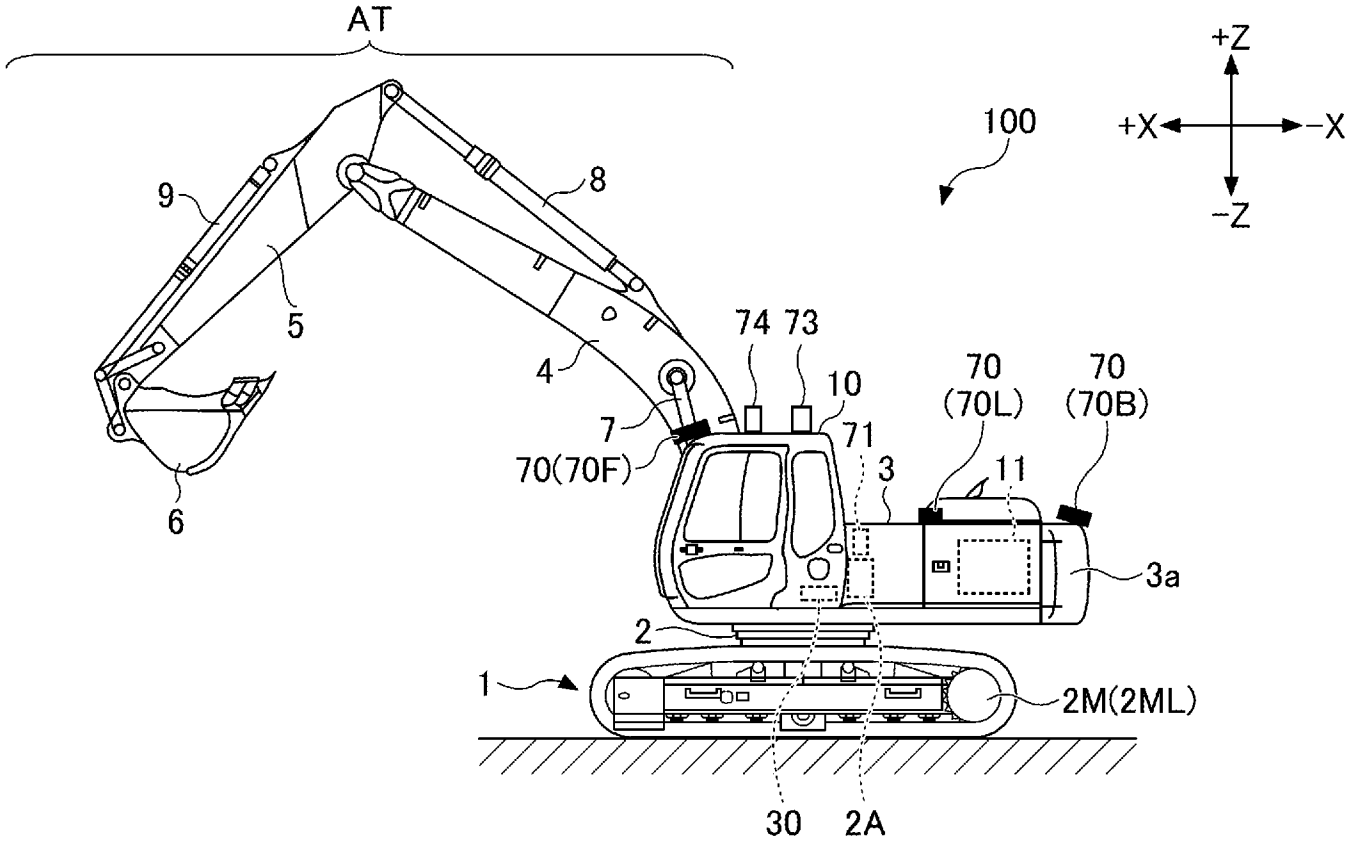
FIG. 2 is a side view of a shovel according to an embodiment.
Figure 3:
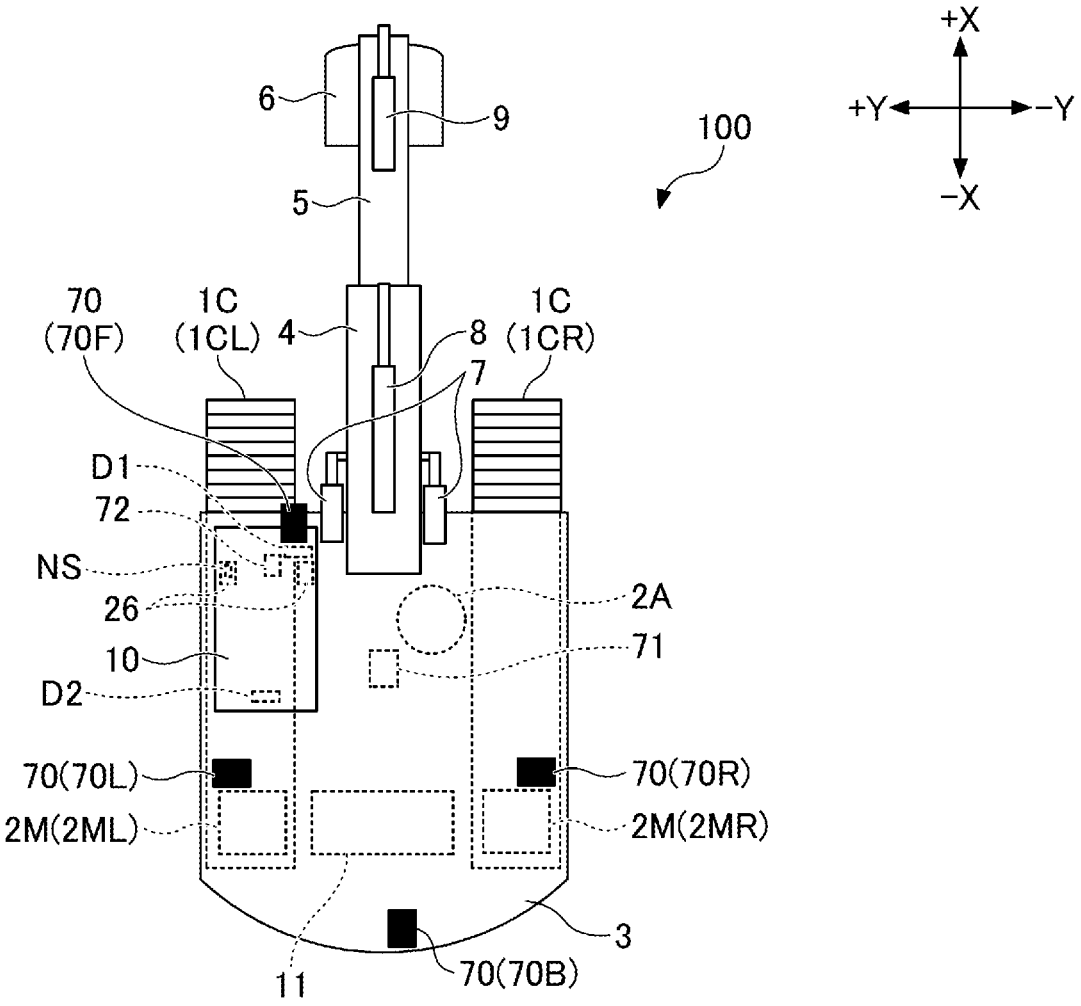
FIG. 3 is a plan view of the shovel of FIG. 2.
Figure 4:
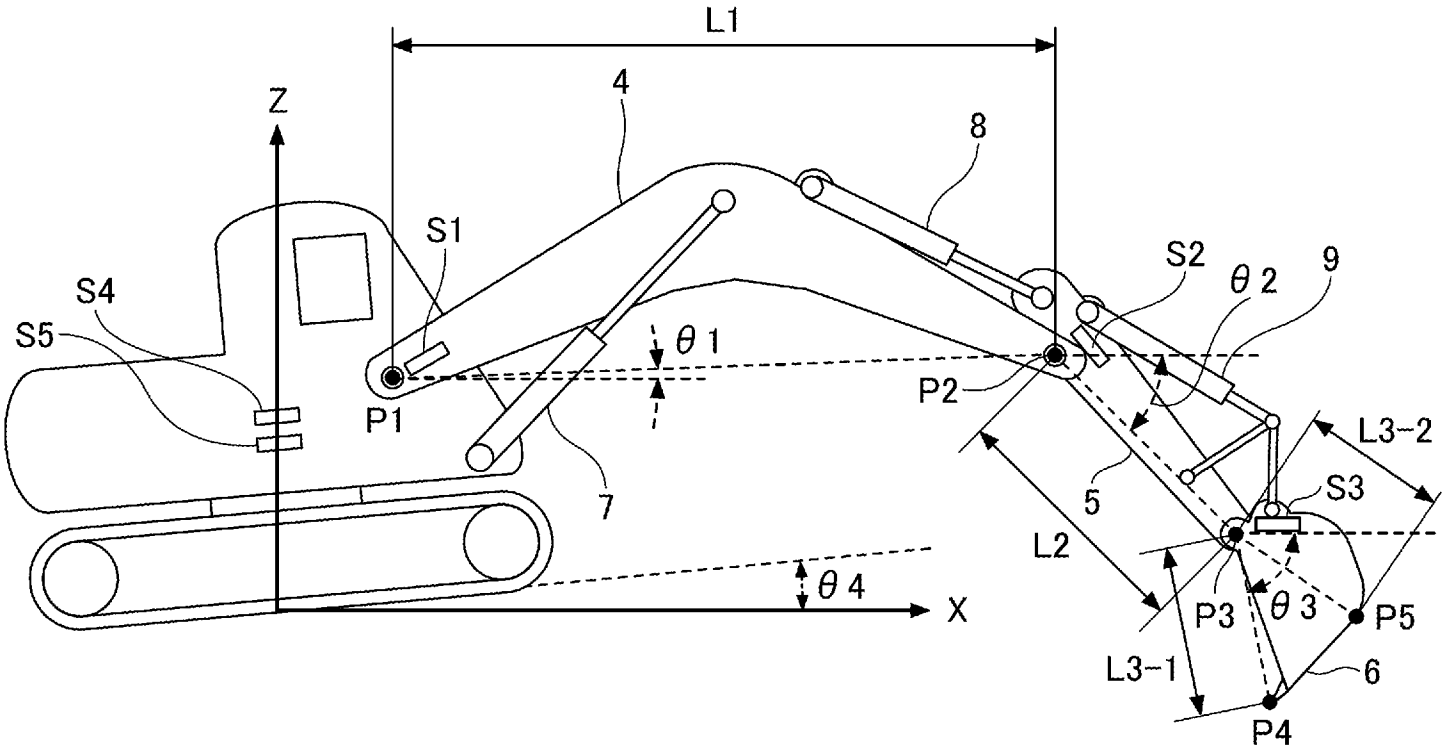
FIG. 4 is a side view of the shovel of FIG. 2, illustrating an example of a pose detector mounted on the shovel.

Next, the shovel 100 according to this embodiment is described with reference to FIGS. 2 through 4. FIG. 2 is a side view of the shovel 100 according to this embodiment. FIG. 3 is a top plan view of the shovel 100 according to this embodiment. FIG. 4 is a side view of the shovel 100 according to this embodiment, illustrating an example of a pose detector mounted on the shovel 100.

According to this embodiment, a lower traveling structure 1 of the shovel 100 includes crawlers 1C. The crawlers 1C are driven by travel hydraulic motors 2M serving as travel actuators mounted on the lower traveling structure 1. Specifically, the crawlers 1C include a left crawler 1CL and a right crawler 1CR. The left crawler 1CL is driven by a left travel hydraulic motor 2ML. The right crawler 1CR is driven by a right travel hydraulic motor 2MR.

An upper swing structure 3 is swingably mounted on the lower traveling structure 1 via a swing mechanism 2. The swing mechanism 2 is driven by a swing hydraulic motor 2A serving as a swing actuator mounted on the upper swing structure 3. The swing actuator may also be a swing motor generator serving as an electric actuator.

A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment AT that is an example of an attachment. The boom 4 is driven by one or more boom cylinders 7 (hereinafter collectively referred to as "boom cylinder 7"). The arm 5 is driven by an arm cylinder 8. The bucket 6 is driven by a bucket cylinder 9. The boom cylinder 7, the arm cylinder 8, and the bucket cylinder 9 constitute attachment actuators. The end attachment may also be a slope bucket. The bucket 6 is removable and is replaced with a grapple, a breaker, a lifting magnet or the like as needed.

The boom 4 is supported in such a manner as to be able to pivot up and down relative to the upper swing structure 3. A boom angle sensor S1 is attached to the boom 4. The boom angle sensor S1 detects a boom angle θ1 that is the pivot angle of the boom 4. The boom angle θ1 is, for example, the angle of a line segment connecting a boom foot pin position P1 and an arm link pin position P2 to a horizontal line in the XZ plane.

The arm 5 is supported in such a manner as to be pivotable relative to the boom 4. An arm angle sensor S2 is attached to the arm 5. The arm angle sensor S2 detects an arm angle θ2 that is the pivot angle of the arm 5. The arm angle θ2 is, for example, the angle of a line segment connecting the arm link pin position P2 and a bucket link pin position P3 to a horizontal line in the XZ plane.

The bucket 6 is supported in such a manner as to be pivotable relative to the arm 5. A bucket angle sensor S3 is attached to the bucket 6. The bucket angle sensor S3 detects a bucket angle θ3 that is the pivot angle of the bucket 6. The bucket angle θ3 is, for example, the angle of a line segment connecting the bucket link pin position P3 and a bucket teeth tips position P4 to a horizontal line in the XZ plane.

In the XZ plane illustrated in FIG. 4, the length of the line segment connecting the boom foot pin position P1 and the arm link pin position P2 is defined as L1, and the length of the ling segment connecting the arm link pin position P2 and the bucket link pin position P3 is defined as L2. Furthermore, the length of the line segment connecting the bucket link pin position P3 and the bucket teeth tips position P4 is defined as L3-1, and the length of a line segment connecting the bucket link pin position P3 and a bucket back surface position P5 is defined as L3-2.

According to this embodiment, each of the boom angle sensor S1, the arm angle sensor S2, and the bucket angle sensor S3 is constituted of a combination of an acceleration sensor and a gyroscope, but may also be constituted of an acceleration sensor only. The boom angle sensor S1 may also be a stroke sensor attached to the boom cylinder 7, a rotary encoder, a potentiometer, an inertial measurement unit, or the like. The same applies to the arm angle sensor S2 and the bucket angle sensor S3.

A cabin 10 serving as a cab is provided and a power source such as an engine 11 is mounted on the upper swing structure 3. The engine 11 is covered with a cover 3*a*. Furthermore, a space recognition device 70, an orientation detector 71, a positioning device 73, a communications device 74, a machine body tilt sensor S4, a swing angular velocity sensor S5, etc., are attached to the upper swing structure 3. An operating device 26, a controller 30, an information input device 72, a display D1, and a sound output device D2, etc., are provided in the cabin 10. In this specification, for convenience, the side of the upper swing structure 3 on which the excavation attachment AT is attached is defined as the front side and the side of the upper swing structure 3 on which a counterweight is attached is defined as the back side.

The space recognition device 70 is configured to recognize an object present in a three-dimensional space surrounding the shovel 100. Furthermore, the space recognition device 70 may also be configured to calculate a distance from the space recognition device 70 or the shovel 100 to the recognized object (for example, the bucket 6). Examples of the space recognition device 70 include an ultrasonic sensor, a millimeter wave radar, a monocular camera, a stereo camera, a light detection and ranging (LIDAR) device, a distance image sensor, an infrared sensor, and any combination thereof. According to this embodiment, the space recognition device 70 includes a front sensor 70F, a back sensor 70B, a left sensor 70L, and a right sensor 70R. The front sensor 70F is attached to the front end of the upper surface of the cabin 10. The back sensor 70B is attached to the back end of the upper surface of the upper swing structure 3. The left sensor 70L is attached to the left end of the upper surface of the upper swing structure 3. The right sensor 70R is attached to the right end of the upper surface of the upper swing structure 3. An upper space sensor configured to recognize an object present in a space over the upper swing structure 3 may also be attached to the shovel 100. Thus, the space recognition device 70 detects obstacles such as electric wires, utility poles, persons, animals, vehicles (such as dump trucks), work equipment, construction machines, buildings, and fences around the shovel 100. Furthermore, the space recognition device 70 may identify a person by a helmet, a safety vest, a predetermined mark attached to workwear or a helmet, or the like. Furthermore, the space recognition device 70 is, for example, a monocular camera including an imaging device such as a CCD or CMOS, and outputs a captured image to the display D1. The space recognition device 70 may also be a LIDAR device, a stereo camera, or a distance image camera. In addition to using a captured image, in the case of using a millimeter wave radar, an ultrasonic sensor, a laser radar, or the like as the space recognition device 70, the space recognition device 70 may emit multiple signals (such as laser beams) to an object, receive signals reflected from the object, and detect the distance and the direction of the object from the reflected signals.

The orientation detector 71 is configured to detect information on the relative relationship between the orientation of the upper swing structure 3 and the orientation of the lower traveling structure 1. The orientation detector 71 may be constituted of, for example, a combination of a geomagnetic sensor attached to the lower traveling structure 1 and a geomagnetic sensor attached to the upper swing structure 3. The orientation detector 71 may also be constituted of a GNSS receiver attached to the lower traveling structure 1 and a GNSS receiver attached to the upper swing structure 3. The orientation detector 71 may also be a rotary encoder, a rotary position sensor or the like, or any combination thereof. In a configuration where the upper swing structure 3 is driven to swing by a swing motor generator, the orientation detector 71 may be constituted of a resolver. The orientation detector 71 may be attached to, for example, a center joint provided in association with the swing mechanism 2, which achieves relative rotation between the lower traveling structure 1 and the upper swing structure 3.

The orientation detector 71 may also be constituted of a camera attached to the upper swing structure 3. In this case, the orientation detector 71 performs known image processing on an image captured by the camera attached to the upper swing structure 3 (an input image) to detect an image of the lower traveling structure 1 included in the input image. The orientation detector 71 identifies the longitudinal direction of the lower traveling structure 1 by detecting an image of the lower traveling structure 1 using a known image recognition technique. The orientation detector 71 derives an angle formed between the direction of the longitudinal axis of the upper swing structure 3 and the longitudinal direction of the lower traveling structure 1. The direction of the longitudinal axis of the upper swing structure 3 is derived from the attachment position of the camera. In particular, the crawlers 10 protrude from the upper swing structure 3. Therefore, the orientation detector 71 can identify the longitudinal direction of the lower traveling structure 1 by detecting an image of the crawlers 1C. In this case, the orientation detector 71 may be integrated with the controller 30. Furthermore, the camera may be the space recognition device 70.

The information input device 72 is configured to enable an operator of the shovel 100 to input information to the controller 30. According to this embodiment, the information input device 72 is a switch panel installed near the display part of the display D1. The information input device 72, however, may also be a touchscreen placed over the display part of the display D1 or a sound input device such as a microphone placed in the cabin 10. The information input device 72 may also be a communications device that obtains external information.

The positioning device 73 is configured to measure the position of the upper swing structure 3. According to this embodiment, the positioning device 73 is a GNSS receiver, and detects the position of the upper swing structure 3 to output a detection value to the controller 30. The positioning device 73 may also be a GNSS compass. In this case, the positioning device 73 can detect the position and the orientation of the upper swing structure 3, and accordingly, also operates as the orientation detector 71.

The communications device 74 is configured to control communications with an external apparatus outside the shovel 100. According to this embodiment, the communications device 74 controls communications with an external apparatus via a communications network such as a satellite communication network, a mobile communication network, or the Internet. The communications device 74 may also control communications with the work assist device 200 via a short-range communication network using Wi-Fi (registered trademark), Bluetooth (registered trademark), a wireless LAN or the like.

The machine body tilt sensor S4 detects the tilt of the upper swing structure 3 with respect to a predetermined plane. According to this embodiment, the machine body tilt sensor S4 is an acceleration sensor that detects a tilt angle 84 of the upper swing structure 3 about its longitudinal axis and the tilt angle of the upper swing structure 3 about its lateral axis relative to a horizontal plane. The longitudinal axis and the lateral axis of the upper swing structure 3, for example, pass through a shovel central point that is a point on the swing axis of the shovel 100, crossing each other at right angles.

The swing angular velocity sensor S5 detects the swing angular velocity of the upper swing structure 3. According to this embodiment, the swing angular velocity sensor S5 is a gyroscope. The swing angular velocity sensor S5 may also be a resolver, a rotary encoder or the like, or any combination thereof. The swing angular velocity sensor S5 may also detect swing speed. The swing speed may be calculated from the swing angular velocity.

In the following, at least one of the boom angle sensor S1, the arm angle sensor S2, the bucket angle sensor S3, the machine body tilt sensor S4, and the swing angular velocity sensor S5 is also referred to as "pose detector." The pose of the excavation attachment AT is detected based on, for example, the respective outputs of the boom angle sensor S1, the arm angle sensor S2, and the bucket angle sensor S3.

The display D1 is a device that displays information. According to this embodiment, the display D1 is a liquid crystal display installed in the cabin 10. The display D1 may also be the display of a portable terminal such as a smartphone.

The sound output device D2 is a device that outputs a sound. The sound output device D2 includes at least one of a device that outputs a sound to the operator in the cabin 10 and a device that outputs a sound to a worker outside the cabin 10. The sound output device D2 may be a loudspeaker of a portable terminal.

The operating device 26 is a device that the operator uses to operate actuators. The operating device 26 includes, for example, an operating lever and an operating pedal. The actuators include at least one of a hydraulic actuator and an electric actuator.

The controller 30 (control device) is processing circuitry configured to control the shovel 100. According to this embodiment, the controller 30 is constituted of a computer including a central processing unit (CPU), a volatile storage, and a non-volatile storage. The controller 30 reads programs corresponding to functions from the non-volatile storage, loads the read programs into the volatile storage, and causes the CPU to execute corresponding processes. The functions include, for example, a machine guidance function and a machine control function. The machine guidance function guides the operator in manually operating the shovel 100. The machine control function assists the operator in manually operating the shovel 100 and causes the shovel 100 to automatically or autonomously operate. The controller 30 may also include a contact avoidance function that causes the shovel 100 to automatically or autonomously operate or stop to avoid contacting an object present around the shovel 100.

Figure 5:
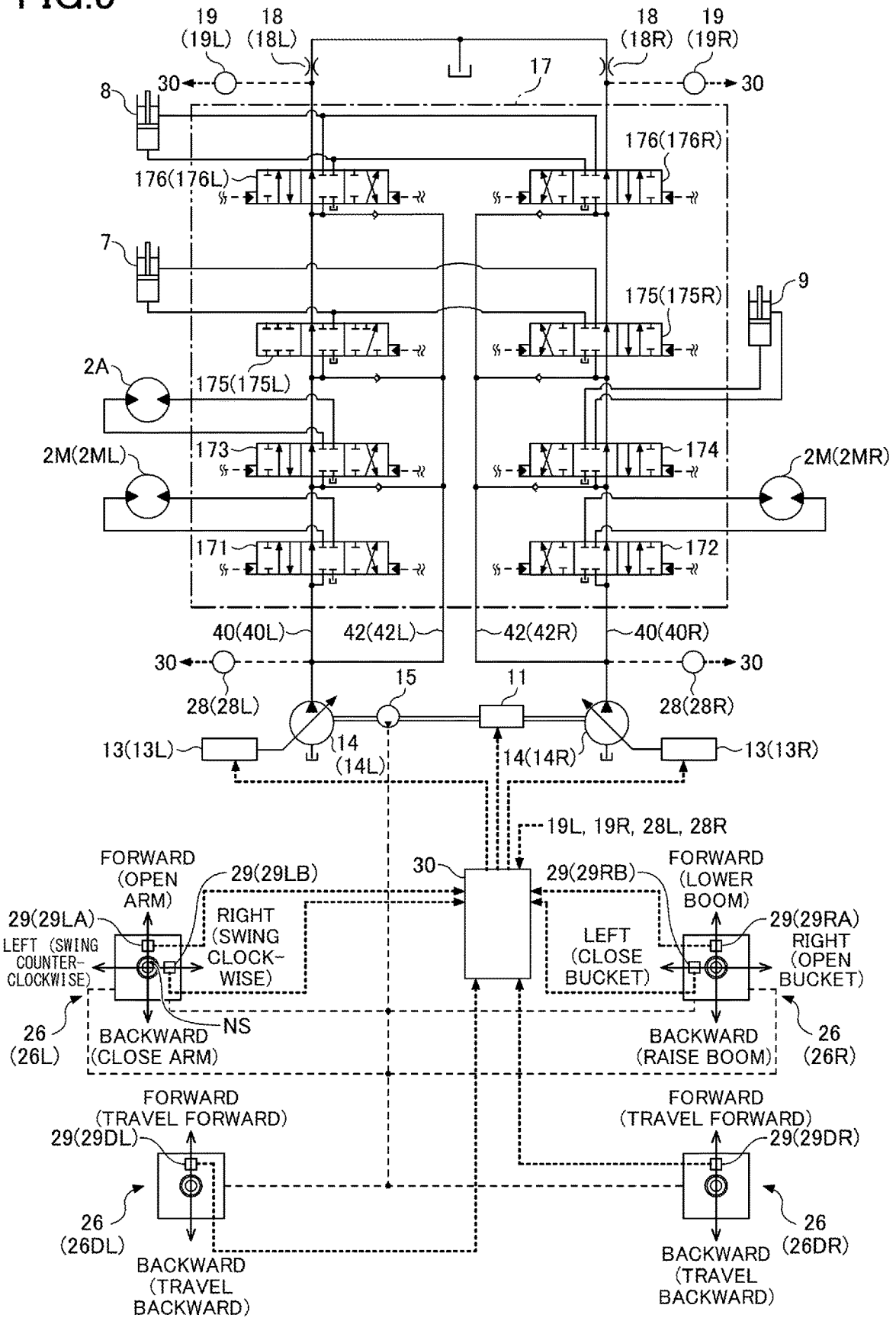
FIG. 5 is a diagram illustrating an example configuration of a hydraulic system installed in the shovel of FIG. 2.

Next, an example configuration of a hydraulic system installed in the shovel 100 is described with reference to FIG. 5. FIG. 5 is a diagram illustrating an example configuration of the hydraulic system installed in the shovel 100. In FIG. 5, a mechanical power transmission system, a hydraulic oil line, a pilot line, and an electrical control system are indicated by a double line, a solid line, a dashed line, and a dotted line, respectively.

The hydraulic system of the shovel 100 includes the engine 11, a regulator 13, a main pump 14, a pilot pump 15, a control valve 17, the operating device 26, a discharge pressure sensor 28, an operating pressure sensor 29, and the controller 30.

Referring to FIG. 5, the hydraulic system circulates hydraulic oil from the main pump 14 driven by the engine 11 to a hydraulic oil tank via a center bypass conduit 40 or a parallel conduit 42. The center bypass conduit 40 includes a left center bypass conduit 40L and a right center bypass conduit 40R. The parallel conduit 42 includes a left parallel conduit 42L and a right parallel conduit 42R.

The engine 11 is a drive source of the shovel 100. According to this embodiment, the engine 11 is, for example, a diesel engine that operates to maintain a predetermined rotational speed. The output shaft of the engine 11 is connected to the respective input shafts of the main pump 14 and the pilot pump 15.

The main pump 14 supplies hydraulic oil to the control valve 17 via a hydraulic oil line. According to this embodiment, the main pump 14 is a swash plate variable displacement hydraulic pump.

The regulator 13 controls the discharge quantity of the main pump 14. According to this embodiment, the regulator 13 controls the discharge quantity of the main pump 14 by adjusting the swash plate tilt angle of the main pump 14 in response to a control command from the controller 30.

The pilot pump 15 is an example of a pilot pressure generator, and supplies hydraulic oil to hydraulic control apparatuses including the operating device 26 via a pilot line. According to this embodiment, the pilot pump 15 is a fixed displacement hydraulic pump. The pilot pressure generator, however, may be implemented by the main pump 14. That is, in addition to the function of supplying hydraulic oil to the control valve 17 via a hydraulic oil line, the main pump 14 may have the function of supplying hydraulic oil to various kinds of hydraulic control apparatuses including the operating device 26 via a pilot line. In this case, the pilot pump 15 may be omitted.

The control valve 17 is a hydraulic controller that controls the hydraulic system in the shovel 100. According to this embodiment, the control valve 17 includes control valves 171 through 176. The control valve 175 includes a control valve 175L and a control valve 175R. The control valve 176 includes a control valve 176L and a control valve 176R. The control valve 17 selectively supplies hydraulic oil discharged by the main pump 14 to one or more hydraulic actuators through the control valves 171 through 176. The control valves 171 through 176 control, for example, the flow rate of hydraulic oil flowing from the main pump 14 to hydraulic actuators and the flow rate of hydraulic oil flowing from hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the swing hydraulic motor 2A.

The operating device 26 supplies hydraulic oil discharged by the pilot pump 15 to a pilot port of a corresponding control valve in the control valve 17 via a pilot line. The pressure of hydraulic oil (pilot pressure) supplied to each pilot port is a pressure commensurate with the direction of operation and the amount of operation of the operating device 26 associated with a corresponding hydraulic actuator. The operating device 26, however, may be an electrical control type instead of the above-described pilot pressure type. In this case, the control valves in the control valve 17 may be electromagnetic solenoid spool valves.

The discharge pressure sensor 28 detects the discharge pressure of the main pump 14. According to this embodiment, the discharge pressure sensor 28 outputs a detected value to the controller 30.

The operating pressure sensor 29 detects the details of the operator's operation on the operating device 26. According to this embodiment, the operating pressure sensor 29 detects the direction of operation and the amount of operation of the operating device 26 associated with a corresponding actuator in the form of pressure (operating pressure), and outputs a detected value to the controller 30. The details of the operation of the operating device 26 may also be detected using a sensor other than an operating pressure sensor.

The main pump 14 includes a left main pump 14L and a right main pump 14R. The left main pump 14L circulates hydraulic oil to the hydraulic oil tank via the left center bypass conduit 40L or the left parallel conduit 42L. The right main pump 14R circulates hydraulic oil to the hydraulic oil tank via the right center bypass conduit 40R or the right parallel conduit 42R.

The left center bypass conduit 40L is a hydraulic oil line passing through the control valves 171, 173, 175L and 176L placed in the control valve 17. The right center bypass conduit 40R is a hydraulic oil line passing through the control valves 172, 174, 175R and 176R placed in the control valve 17.

The control valve 171 is a spool valve that switches the flow of hydraulic oil in order to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil in order to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil in order to supply hydraulic oil discharged by the left main pump 14L to the swing hydraulic motor 2A and to discharge hydraulic oil discharged by the swing hydraulic motor 2A to the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil in order to supply hydraulic oil discharged by the left main pump 14L to the boom cylinder 7. The control valve 175R is a spool valve that switches the flow of hydraulic oil in order to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 to the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 to the hydraulic oil tank.

The left parallel conduit 42L is a hydraulic oil line that runs parallel to the left center bypass conduit 40L. When the flow of hydraulic oil through the left center bypass conduit 40L is restricted or blocked by any of the control valves 171, 173 and 175L, the left parallel conduit 42L supplies hydraulic oil to a control valve further downstream.

The right parallel conduit 42R is a hydraulic oil line that runs parallel to the right center bypass conduit 40R. When the flow of hydraulic oil through the right center bypass conduit 40R is restricted or blocked by any of the control valves 172, 174 and 175R, the right parallel conduit 42R supplies hydraulic oil to a control valve further downstream.

The regulator 13 includes a left regulator 13L and a right regulator 13R. The left regulator 13L controls the discharge quantity of the left main pump 14L by adjusting the swash plate tilt angle of the left main pump 14L in accordance with the discharge pressure of the left main pump 14L. Specifically, for example, the left regulator 13L reduces the discharge quantity of the left main pump 14L by adjusting its swash plate tilt angle as the discharge pressure of the left main pump 14L increases. The same applies to the right regulator 13R. This is for preventing the absorbed power (absorbed horsepower) of the main pump 14 expressed as the product of discharge pressure and discharge quantity from exceeding the output power (output horsepower) of the engine 11.

The operating device 26 includes a left operating lever 26L, a right operating lever 26R, and travel levers 26D. The travel levers 26D include a left travel lever 26DL and a right travel lever 26DR.

The left operating lever 26L is used to swing the upper swing structure 3 and to operate the arm 5. The left operating lever 26L is operated forward or backward to introduce a control pressure commensurate with the amount of lever operation to a pilot port of the control valve 176, using hydraulic oil discharged by the pilot pump 15. Furthermore, the left operating lever 26L is operated rightward or leftward to introduce a control pressure commensurate with the amount of lever operation to a pilot port of the control valve 173, using hydraulic oil discharged by the pilot pump 15.

Specifically, the left operating lever 26L is operated in an arm closing direction to introduce hydraulic oil to the right pilot port of the control valve 176L and introduce hydraulic oil to the left pilot port of the control valve 176R. Furthermore, the left operating lever 26L is operated in an arm opening direction to introduce hydraulic oil to the left pilot port of the control valve 176L and introduce hydraulic oil to the right pilot port of the control valve 176R. Furthermore, the left operating lever 26L is operated in a counterclockwise swing direction to introduce hydraulic oil to the left pilot port of the control valve 173, and is operated in a clockwise swing direction to introduce hydraulic oil to the right pilot port of the control valve 173.

The right operating lever 26R is used to operate the boom 4 and to operate the bucket 6. The right operating lever 26R is operated forward or backward to introduce a control pressure commensurate with the amount of lever operation to a pilot port of the control valve 175, using hydraulic oil discharged by the pilot pump 15. Furthermore, the right operating lever 26R is operated rightward or leftward to introduce a control pressure commensurate with the amount of lever operation to a pilot port of the control valve 174, using hydraulic oil discharged by the pilot pump 15.

Specifically, the right operating lever 26R is operated in a boom lowering direction to introduce hydraulic oil to the right pilot port of the control valve 175R. Furthermore, the right operating lever 26R is operated in a boom raising direction to introduce hydraulic oil to the right pilot port of the control valve 175L and to introduce hydraulic oil to the left pilot port of the control valve 175R. Furthermore, the right operating lever 26R is operated in a bucket closing direction to introduce hydraulic oil to the left pilot port of the control valve 174, and is operated in a bucket opening direction to introduce hydraulic oil to the right pilot port of the control valve 174.

The travel levers 26D are used to operate the crawlers 10. Specifically, the left travel lever 26DL is used to operate the left crawler 1CL. The left travel lever 26DL may be configured to operate together with a left travel pedal. The left travel lever 26DL is operated forward or backward to introduce a control pressure commensurate with the amount of lever operation to a pilot port of the control valve 171, using hydraulic oil discharged by the pilot pump 15. The right travel lever 26DR is used to operate the right crawler 1CR. The right travel lever 26DR may be configured to operate together with a right travel pedal. The right travel lever 26DR is operated forward or backward to introduce a control pressure commensurate with the amount of lever operation to a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs a detected value to the controller 30. The same is the case with the discharge pressure sensor 28R.

The operating pressure sensor 29 includes operating pressure sensors 29LA, 29LB, 29RA, 29RB, 29DL and 29DR. The operating pressure sensor 29LA detects the details of the operator's forward or backward operation of the left operating lever 26L in the form of pressure, and outputs a detected value to the controller 30. Examples of the details of operation include the direction of lever operation and the amount of lever operation (the angle of lever operation).

Likewise, the operating pressure sensor 29LB detects the details of the operator's rightward or leftward operation of the left operating lever 26L in the form of pressure, and outputs a detected value to the controller 30. The operating pressure sensor 29RA detects the details of the operator's forward or backward operation of the right operating lever 26R in the form of pressure, and outputs a detected value to the controller 30. The operating pressure sensor 29RB detects the details of the operator's rightward or leftward operation of the right operating lever 26R in the form of pressure, and outputs a detected value to the controller 30. The operating pressure sensor 29DL detects the details of the operator's forward or backward operation of the left travel lever 26DL in the form of pressure, and outputs a detected value to the controller 30. The operating pressure sensor 29DR detects the details of the operator's forward or backward operation of the right travel lever 26DR in the form of pressure, and outputs a detected value to the controller 30.

The controller 30 receives the output of the operating pressure sensor 29, and outputs a control command to the regulator 13 to change the discharge quantity of the main pump 14 on an as-needed basis. Furthermore, the controller 30 receives the output of a control pressure sensor 19 provided upstream of a throttle 18, and outputs a control command to the regulator 13 to change the discharge quantity of the main pump 14 on an as-needed basis. The throttle 18 includes a left throttle 18L and a right throttle 18R. The control pressure sensor 19 includes a left control pressure sensor 19L and a right control pressure sensor 19R.

The left throttle 18L is placed between the most downstream control valve 176L and the hydraulic oil tank in the left center bypass conduit 40L. Therefore, the flow of hydraulic oil discharged by the left main pump 14L is restricted by the left throttle 18L. The left throttle 18L generates a control pressure for controlling the left regulator 13L. The left control pressure sensor 19L is a sensor for detecting this control pressure, and outputs a detected value to the controller 30. The controller 30 controls the discharge quantity of the left main pump 14L by adjusting the swash plate tilt angle of the left main pump 14L in accordance with this control pressure. The controller 30 decreases the discharge quantity of the left main pump 14L as this control pressure increases, and increases the discharge quantity of the left main pump 14L as this control pressure decreases. The discharge quantity of the right main pump 14R is controlled in the same manner.

Specifically, as illustrated in FIG. 5, in a standby state where none of the hydraulic actuators is operated in the shovel 100, hydraulic oil discharged by the left main pump 14L arrives at the left throttle 18L through the left center bypass conduit 40L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to reduce pressure loss (pumping loss) during the passage of the discharged hydraulic oil through the left center bypass conduit 40L. In contrast, when any of the hydraulic actuators is operated, hydraulic oil discharged by the left main pump 14L flows into the operated hydraulic actuator via a control valve corresponding to the operated hydraulic actuator. The flow of hydraulic oil discharged by the left main pump 14L that arrives at the left throttle 18L is reduced in amount or lost, so that the control pressure generated upstream of the left throttle 18L is reduced. As a result, the controller 30 increases the discharge quantity of the left main pump 14L to cause sufficient hydraulic oil to flow into the operated hydraulic actuator to ensure driving of the operated hydraulic actuator. The controller 30 controls the discharge quantity of the right main pump 14R in the same manner.

According to the configuration as described above, the hydraulic system of FIG. 5 can reduce unnecessary energy consumption in the main pump 14 in the standby state. The unnecessary energy consumption includes pumping loss that hydraulic oil discharged by the main pump 14 causes in the center bypass conduit 40. Furthermore, in the case of actuating a hydraulic actuator, the hydraulic system of FIG. 5 can ensure that necessary and sufficient hydraulic oil is supplied from the main pump 14 to the hydraulic actuator to be actuated.

Figure 6A:
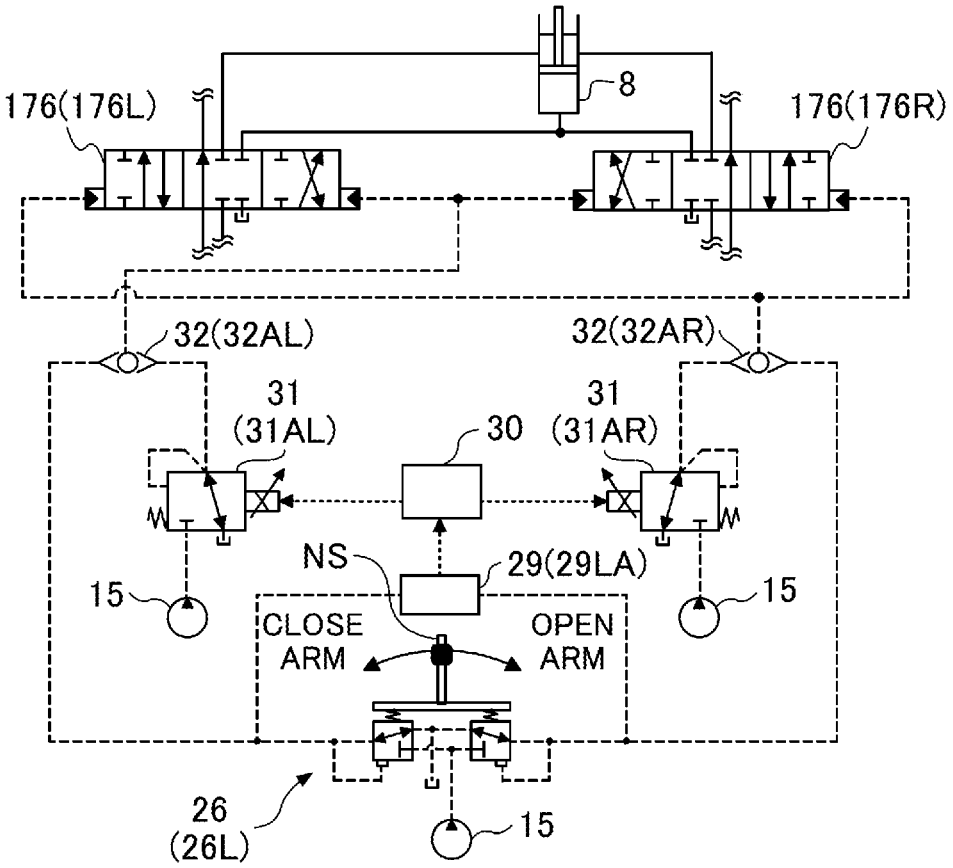
FIG. 6A is a diagram extracting part of the hydraulic system installed in the shovel of FIG. 2.
Figure 6B:
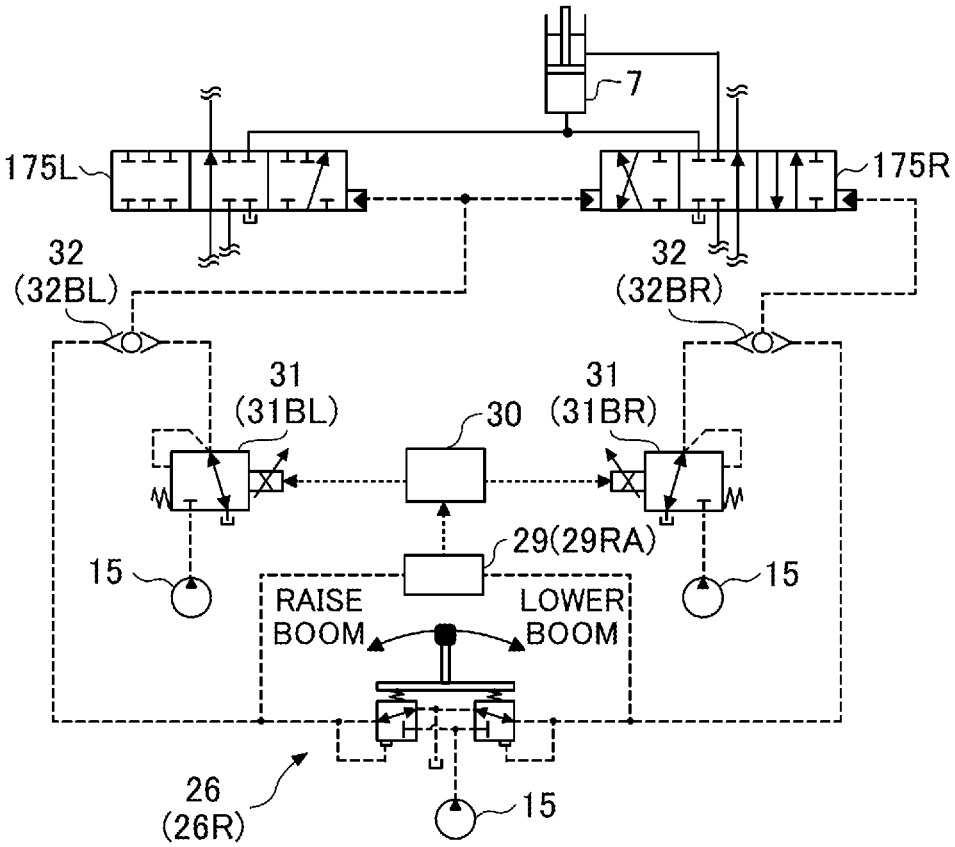
FIG. 6B is a diagram extracting part of the hydraulic system installed in the shovel of FIG. 2.
Figure 6C:
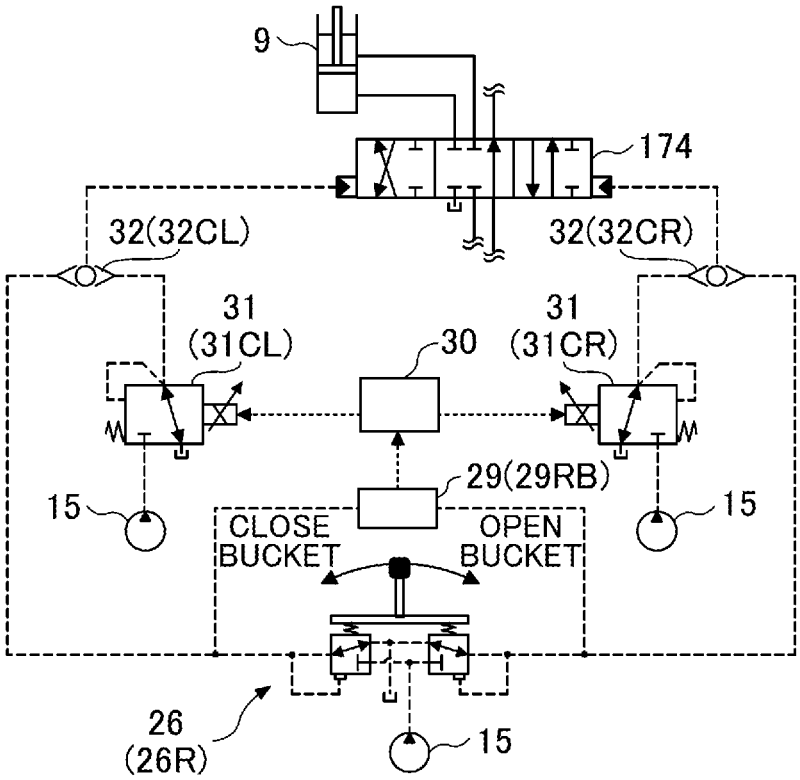
FIG. 6C is a diagram extracting part of the hydraulic system installed in the shovel of FIG. 2.
Figure 6D:
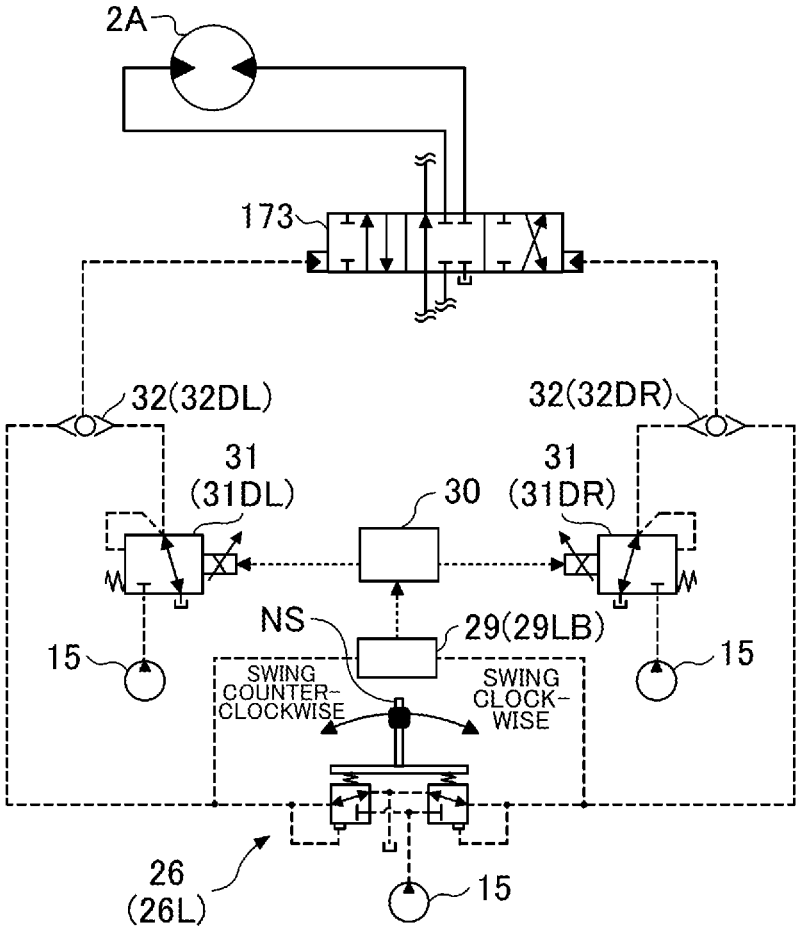
FIG. 6D is a diagram extracting part of the hydraulic system installed in the shovel of FIG. 2.

Next, configurations for the controller 30 operating actuators through the machine control function are described with reference to FIGS. 6A through 6D. FIGS. 6A through 6D are diagrams extracting part of the hydraulic system installed in the shovel 100. Specifically, FIG. 6A is a diagram extracting part of the hydraulic system related to the operation of the arm cylinder 8. FIG. 6B is a diagram extracting part of the hydraulic system related to the operation of the boom cylinder 7. FIG. 6C is a diagram extracting part of the hydraulic system related to the operation of the bucket cylinder 9. FIG. 6D is a diagram extracting part of the hydraulic system related to the operation of the swing hydraulic motor 2A.

As illustrated in FIGS. 6A through 6D, the hydraulic system includes a proportional valve 31 and a shuttle valve 32. The proportional valve 31 includes proportional valves 31AL, 31BL, 31CL, 31DL, 31AR, 31BR, 31CR and 31DR. The shuttle valve 32 includes shuttle valves 32AL, 32BL, 32CL, 32DL, 32AR, 32BR, 32CR and 32DR.

The proportional valve 31 operates as a control valve for machine control. The proportional valve 31 is placed in a conduit connecting the pilot pump 15 and the shuttle valve 32, and is configured to be able to change the flow area of the conduit. According to this embodiment, the proportional valve 31 operates in response to a control command output by the controller 30. Therefore, the controller 30 can supply hydraulic oil discharged by the pilot pump 15 to a pilot port of a corresponding control valve in the control valve 17 through the proportional valve 31 and the shuttle valve 32, independent of the operator's operation of the operating device 26.

The shuttle valve 32 includes two inlet ports and one outlet port. Of the two inlet ports, one is connected to the operating device 26 and the other is connected to the proportional valve 31. The outlet port is connected to a pilot port of a corresponding control valve in the control valve 17. Therefore, the shuttle valve 32 can cause the higher one of a pilot pressure generated by the operating device 26 and a pilot pressure generated by the proportional valve 31 to act on a pilot port of a corresponding control valve.

According to this configuration, even when no operation is performed on a specific operating device in the operating device 26, the controller 30 can operate a hydraulic actuator corresponding to the specific operating device.

For example, as illustrated in FIG. 6A, the left operating lever 26L is used to operate the arm 5. Specifically, the left operating lever 26L causes a pilot pressure commensurate with a forward or backward operation to act on a pilot port of the control valve 176, using hydraulic oil discharged by the pilot pump 15. More specifically, when operated in the arm closing direction (backward direction), the left operating lever 26L causes a pilot pressure commensurate with the amount of operation to act on the right pilot port of the control valve 176L and the left pilot port of the control valve 176R. Furthermore, when operated in the am opening direction (forward direction), the left operating lever 26L causes a pilot pressure commensurate with the amount of operation to act on the left pilot port of the control valve 176L and the right pilot port of the control valve 176R.

The left operating lever 26L is provided with a switch NS. According to this embodiment, the switch NS is a push button switch provided at the top of the left operating lever 26L. The operator can operate the left operating lever 26L while pressing the switch NS. The switch NS may also be provided on the right operating lever 26R or at a different position in the cabin 10.

The operating pressure sensor 29LA detects the details of the operator's forward or backward operation of the left operating lever 26L in the form of pressure, and outputs a detected value to the controller 30.

The proportional valve 31AL operates in response to a control command (a current command) output by the controller 30. The proportional valve 31AL controls a pilot pressure generated by hydraulic oil introduced to the right pilot port of the control valve 176L and the left pilot port of the control valve 176R from the pilot pump 15 through the proportional valve 31AL and the shuttle valve 32AL. The proportional valve 31AR operates in response to a control command (a current command) output by the controller 30. The proportional valve 31AR controls a pilot pressure generated by hydraulic oil introduced to the left pilot port of the control valve 17*a* and the right pilot port of the control valve 176R from the pilot pump 15 through the proportional valve 31AR and the shuttle valve 32AR. The proportional valves 31AL and 31AR can control a pilot pressure such that the control valves 176L and 176R can stop at a desired valve position.

According to this configuration, the controller 30 can supply hydraulic oil discharged by the pilot pump 15 to the right pilot port of the control valve 176L and the left pilot port of the control valve 176R through the proportional valve 31AL and the shuttle valve 32AL, that is, can close the arm 5, independent of the operator's arm closing operation. Furthermore, the controller 30 can supply hydraulic oil discharged by the pilot pump 15 to the left pilot port of the control valve 176L and the right pilot port of the control valve 176R through the proportional valve 31AR and the shuttle valve 32AR, that is, can open the arm 5, independent of the operator's arm opening operation.

As illustrated in FIG. 6B, the right operating lever 26R is used to operate the boom 4. Specifically, the right operating lever 26R causes a pilot pressure commensurate with a forward or backward operation to act on a pilot port of the control valve 175, using hydraulic oil discharged by the pilot pump 15. More specifically, when operated in the boom raising direction (backward direction), the right operating lever 26R causes a pilot pressure commensurate with the amount of operation to act on the right pilot port of the control valve 175L and the left pilot port of the control valve 175R. Furthermore, when operated in the boom lowering direction (forward direction), the right operating lever 26R causes a pilot pressure commensurate with the amount of operation to act on the right pilot port of the control valve 175R.

The operating pressure sensor 29RA detects the details of the operator's forward or backward operation of the right operating lever 26R in the form of pressure, and outputs a detected value to the controller 30.

The proportional valve 31BL operates in response to a control command (a current command) output by the controller 30. The proportional valve 31BL controls a pilot pressure generated by hydraulic oil introduced to the right pilot port of the control valve 175L and the left pilot port of the control valve 175R from the pilot pump 15 through the proportional valve 31BL and the shuttle valve 32BL. The proportional valve 31BR operates in response to a control command (a current command) output by the controller 30. The proportional valve 31BR controls a pilot pressure generated by hydraulic oil introduced to the right pilot port of the control valve 175R from the pilot pump 15 through the proportional valve 31BR and the shuttle valve 32BR. The proportional valves 31BL and 31BR can control a pilot pressure such that the control valves 175L and 175R can stop at a desired valve position.

According to this configuration, the controller 30 can supply hydraulic oil discharged by the pilot pump 15 to the right pilot port of the control valve 175L and the left pilot port of the control valve 175R through the proportional valve 31BL and the shuttle valve 32BL, that is, can raise the boom 4, independent of the operator's boom raising operation. Furthermore, the controller 30 can supply hydraulic oil discharged by the pilot pump 15 to the right pilot port of the control valve 175R through the proportional valve 31BR and the shuttle valve 32BR, that is, can lower the boom 4, independent of the operator's boom lowering operation.

Furthermore, as illustrated in FIG. 6C, the right operating lever 26R is also used to operate the bucket 6. Specifically, the right operating lever 26R causes a pilot pressure commensurate with a rightward or leftward operation to act on a pilot port of the control valve 174, using hydraulic oil discharged by the pilot pump 15. More specifically, when operated in the bucket closing direction (leftward direction), the right operating lever 26R causes a pilot pressure commensurate with the amount of operation to act on the left pilot port of the control valve 174. Furthermore, when operated in the bucket opening direction (rightward direction), the right operating lever 26R causes a pilot pressure commensurate with the amount of operation to act on the right pilot port of the control valve 174.

The operating pressure sensor 29RB detects the details of the operator's rightward or leftward operation of the right operating lever 26R in the form of pressure, and outputs a detected value to the controller 30.

The proportional valve 31CL operates in response to a control command (a current command) output by the controller 30. The proportional valve 31CL controls a pilot pressure generated by hydraulic oil introduced to the left pilot port of the control valve 174 from the pilot pump 15 through the proportional valve 31CL and the shuttle valve 32CL. The proportional valve 31CR operates in response to a control command (a current command) output by the controller 30. The proportional valve 31CR controls a pilot pressure generated by hydraulic oil introduced to the right pilot port of the control valve 174 from the pilot pump 15 through the proportional valve 31CR and the shuttle valve 32CR. The proportional valves 31CL and 31CR can control a pilot pressure such that the control valve 174 can stop at a desired valve position.

According to this configuration, the controller 30 can supply hydraulic oil discharged by the pilot pump 15 to the left pilot port of the control valve 174 through the proportional valve 31CL and the shuttle valve 32CL, that is, can close the bucket 6, independent of the operator's bucket closing operation. Furthermore, the controller 30 can supply hydraulic oil discharged by the pilot pump 15 to the right pilot port of the control valve 174 through the proportional valve 31CR and the shuttle valve 32CR, that is, can open the bucket 6, independent of the operator's bucket opening operation.

Furthermore, as illustrated in FIG. 6D, the left operating lever 26L is also used to operate the swing mechanism 2. Specifically, the left operating lever 26L causes a pilot pressure commensurate with a rightward or leftward operation to act on a pilot port of the control valve 173, using hydraulic oil discharged by the pilot pump 15. More specifically, when operated in the counterclockwise swing direction (leftward direction), the left operating lever 26L causes a pilot pressure commensurate with the amount of operation to act on the left pilot port of the control valve 173. Furthermore, when operated in the clockwise swing direction (rightward direction), the left operating lever 26L causes a pilot pressure commensurate with the amount of operation to act on the right pilot port of the control valve 173.

The operating pressure sensor 29LB detects the details of the operator's rightward or leftward operation of the left operating lever 26L in the form of pressure, and outputs a detected value to the controller 30.

The proportional valve 31DL operates in response to a control command (a current command) output by the controller 30. The proportional valve 31DL controls a pilot pressure generated by hydraulic oil introduced to the left pilot port of the control valve 173 from the pilot pump 15 through the proportional valve 31DL and the shuttle valve 32DL. The proportional valve 31DR operates in response to a control command (a current command) output by the controller 30. The proportional valve 31DR controls a pilot pressure generated by hydraulic oil introduced to the right pilot port of the control valve 173 from the pilot pump 15 through the proportional valve 31DR and the shuttle valve 32DR. The proportional valves 31DL and 31DR can control a pilot pressure such that the control valve 173 can stop at a desired valve position.

According to this configuration, the controller 30 can supply hydraulic oil discharged by the pilot pump 15 to the left side pilot port of the control valve 173 through the proportional valve 31DL and the shuttle valve 32DL, that is, can swing the swing mechanism 2 counterclockwise, independent of the operator's counterclockwise swing operation. Furthermore, the controller 30 can supply hydraulic oil discharged by the pilot pump 15 to the right pilot port of the control valve 173 through the proportional valve 31DR and the shuttle valve 32DR, that is, can swing the swing mechanism 2 clockwise, independent of the operator's clockwise swing operation.

The shovel 100 may also be configured to cause the lower traveling structure 1 to automatically or autonomously travel forward and backward. In this case, part of the hydraulic system related to the operation of the left travel hydraulic motor 2ML and part of the hydraulic system related to the operation of the right travel hydraulic motor 2MR may be configured the same as part of the hydraulic system related to the operation of the boom cylinder 7, etc.

Furthermore, while a hydraulic operating lever including a hydraulic pilot circuit is described above as a form of the operating device 26, an electrical operating lever including an electrical pilot circuit may be employed instead of a hydraulic operating lever. In this case, the amount of lever operation of the electrical operating lever is input to the controller 30 as an electrical signal. Furthermore, a solenoid valve is placed between the pilot pump 15 and a pilot port of each control valve. The solenoid valve is configured to operate in response to an electrical signal from the controller 30. According to this configuration, when a manual operation using the electrical operating lever is performed, the controller 30 can move each control valve by increasing or decreasing a pilot pressure by controlling the solenoid valve using an electrical signal commensurate with the amount of lever operation. Each control valve may be constituted of a solenoid spool valve. In this case, the solenoid spool valve operates in response to an electrical signal from the controller 30 commensurate with the amount of lever operation of the electrical operating lever.

Figure 7:
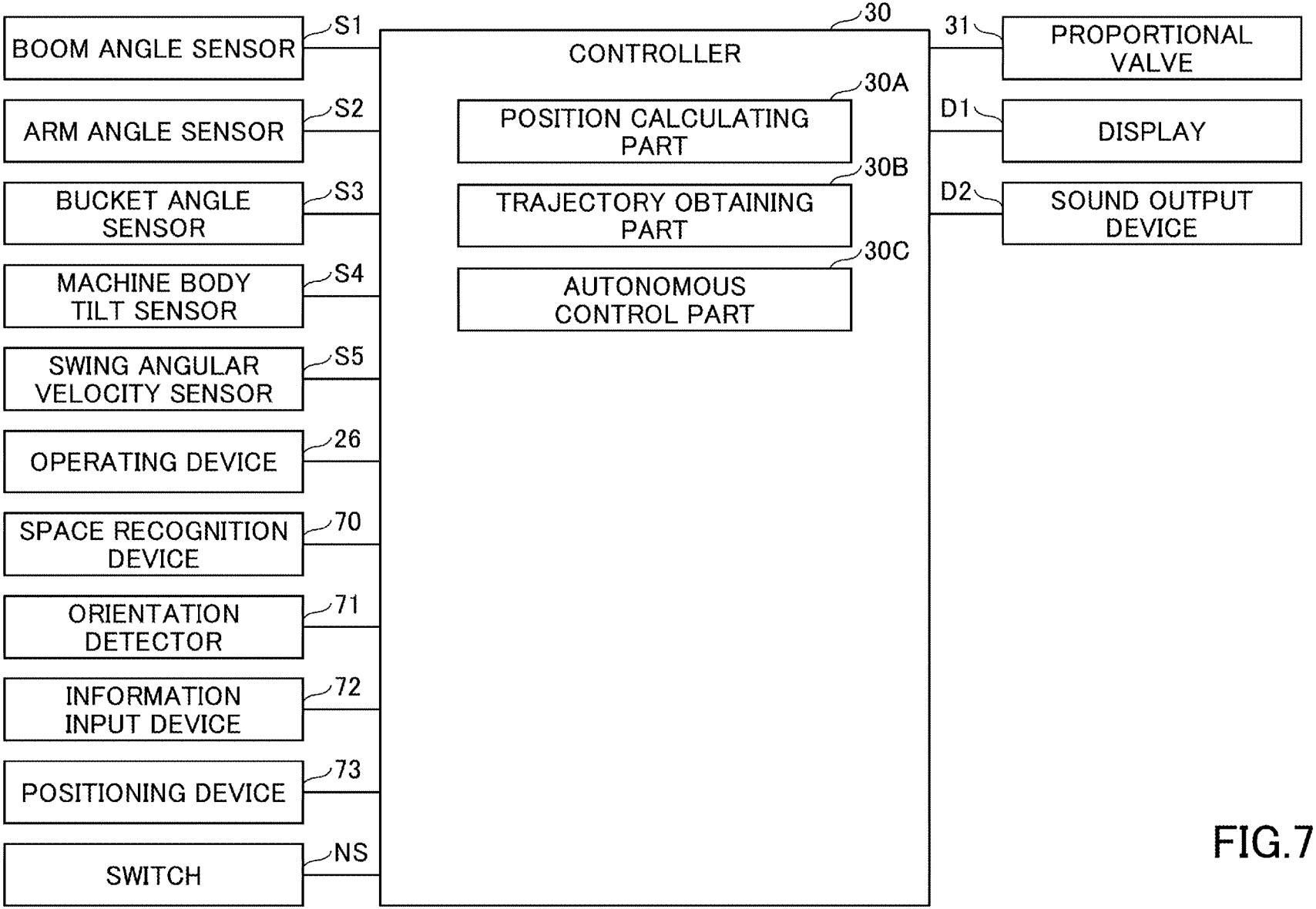
FIG. 7 is a diagram illustrating an example configuration of a controller.

Next, an example configuration of the controller 30 is described with reference to FIG. 7. FIG. 7 is a diagram illustrating an example configuration of the controller 30. According to FIG. 7, the controller 30 receives a signal output by at least one of the pose detector, the operating device 26, the space recognition device 70, the orientation detector 71, the information input device 72, the positioning device 73, the switch NS, etc., executes various computations, and outputs a control signal to at least one of the proportional valve 31, the display D1, the sound output device D2, etc. The pose detector includes the boom angle sensor S1, the arm angle sensor S2, the bucket angle sensor S3, the machine body tilt sensor S4, and the swing angular velocity sensor S5.

The controller 30 includes a position calculating part 30A, a trajectory obtaining part 30B, and an autonomous control part 30C as functional elements. The functional elements may be either constituted of hardware or constituted of software.

The position calculating part 30A calculates the position of an object whose location is to be determined. According to this embodiment, the position calculating part 30A calculates the coordinate point of a predetermined part of the attachment in a reference coordinate system. The predetermined part is, for example, the teeth tips of the bucket 6. The origin of the reference coordinate system is, for example, the point of intersection of the swing axis and the ground contact surface of the shovel 100. The reference coordinate system is, for example, an XYZ Cartesian coordinate system, and has the X-axis parallel to the longitudinal axis of the shovel 100, the Y-axis parallel to the lateral axis of the shovel 100, and the Z-axis parallel to the swing axis of the shovel 100. The position calculating part 30A, for example, calculates the coordinate point of the teeth tips of the bucket 6 from the respective pivot angles of the boom 4, the arm 5, and the bucket 6. The position calculating part 30A may calculate not only the coordinate point of the center of the teeth tips of the bucket 6 but also the coordinate point of the left end of the teeth tips of the bucket 6 and the coordinate point of the right end of the teeth tips of the bucket 6. In this case, the position calculating part 30A may use the output of the machine body tilt sensor S4. Furthermore, the position calculating part 30A may also calculate the coordinate point of the predetermined part of the attachment in the world geodetic system, using the output of the positioning device 73.

The trajectory obtaining part 30B obtains a target trajectory that is a trajectory that a predetermined part of the attachment follows when the shovel 100 is caused to autonomously operate. According to this embodiment, the trajectory obtaining part 30B obtains the target trajectory which the autonomous control part 30C uses when causing the shovel 100 to autonomously operate. Specifically, the trajectory obtaining part 30B derives the target trajectory based on data on an intended surface (hereinafter "design data") stored in a non-volatile storage. The trajectory obtaining part 30B may also derive the target trajectory based on information on landforms around the shovel 100 recognized by the space recognition device 70. The trajectory obtaining part 30B may also derive information on the past trajectories of the teeth tips of the bucket 6 from the past outputs of the pose detector stored in a volatile storage and derive the target trajectory based on the information. The trajectory obtaining part 30B may also derive the target trajectory based on the current position of a predetermined part of the attachment and the design data.

The autonomous control part 30C causes the shovel 100 to autonomously operate. According to this embodiment, the autonomous control part 30C moves a predetermined part of the attachment along the target trajectory obtained by the trajectory obtaining part 30B when a predetermined start condition is satisfied. Specifically, when the operating device 26 is operated with the switch NS being pressed, the autonomous control part 30C causes the shovel 100 to autonomously operate such that the predetermined part moves along the target trajectory.

According to this embodiment, the autonomous control part 30C assists the operators in manually operating the shovel 100 by causing actuators to autonomously operate. For example, when the operator is manually performing an arm closing operation while pressing the switch NS, the autonomous control part 30C may cause at least one of the boom cylinder 7, the arm cylinder 8, and the bucket cylinder 9 to autonomously extend or retract such that the position of the teeth tips of the bucket 6 matches the target trajectory. In this case, for example, the operator can close the arm 5 while matching the teeth tips of the bucket 6 with the target trajectory by operating the left operating lever 26L in the arm closing direction alone. According to this example, the arm cylinder 8 that is a primary target of operation is referred to as "primary actuator." Furthermore, the boom cylinder 7 and the bucket cylinder 9, which are secondary targets of operation that move in accordance with the movement of the primary actuator, are referred to as "secondary actuators".

According to the embodiment, the autonomous control part 30C can cause each actuator to autonomously operate by providing the proportional valve 31 with a control command (a current command) to individually control a pilot pressure acting on a control valve corresponding to each actuator. For example, independent of whether the right operating lever 26R is tilted or not, the autonomous control part 30C can cause at least one of the boom cylinder 7 and the bucket cylinder 9 to operate.

Figure 8:
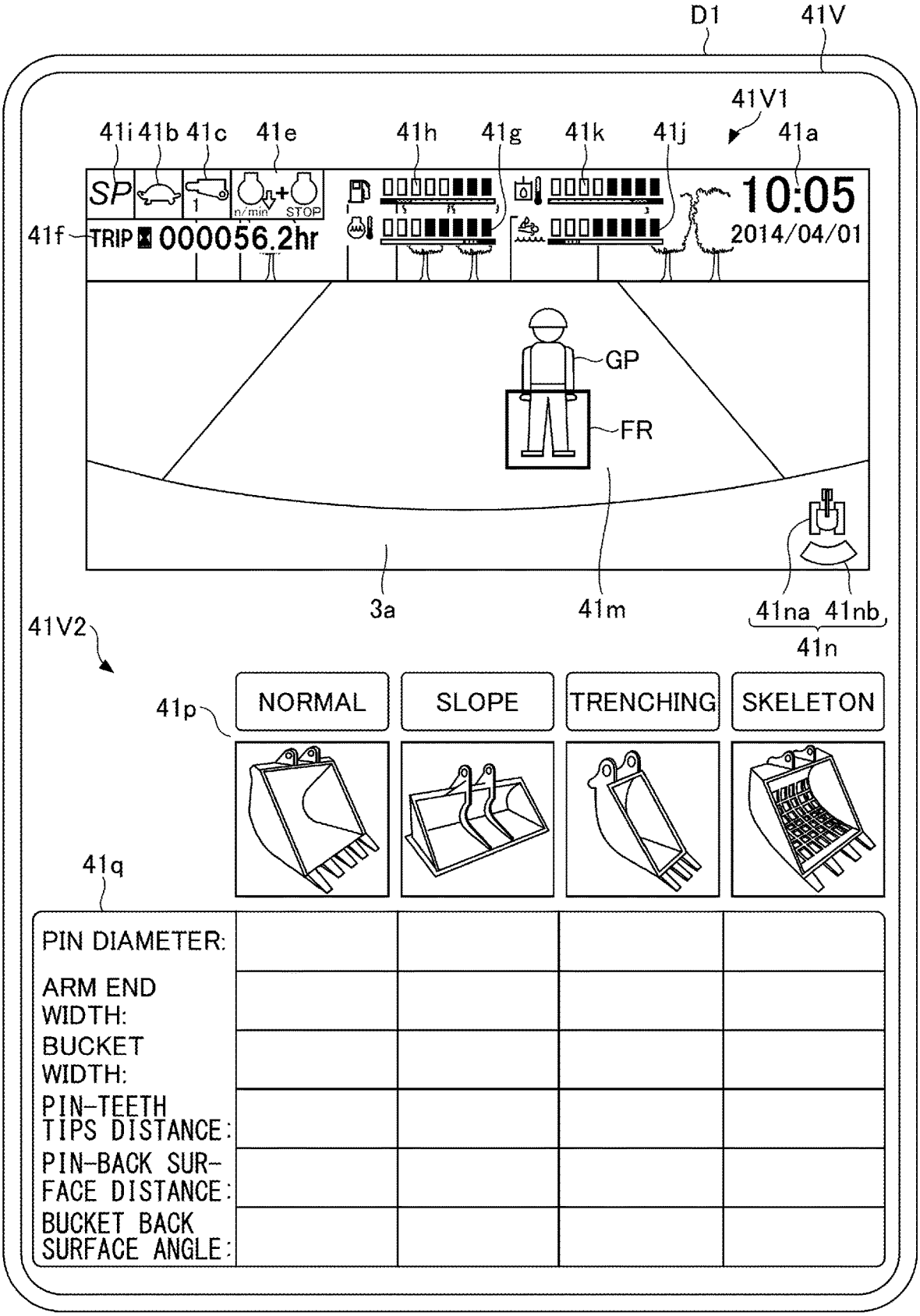
FIG. 8 is a diagram illustrating an example configuration of a display screen displayed on a display.

Next, as a first example of the process of the controller 30 setting the shape parameters of the bucket 6 according to a bucket shape obtained in advance, a process of the controller 30 changing the shape parameters of the bucket 6 according to a selected bucket shape when a bucket shape representing the shape of the bucket 6 is selected is described with reference to FIG. 8. FIG. 8 is a diagram illustrating an example configuration of a display screen 41V displayed on the display D1.

As illustrated in FIG. 8, the display screen 41V includes a state display area 41V1 including various kinds of operating information and an image captured by the space recognition device 70 and a bucket selection area 41V2 including bucket shapes and shape parameters associated with the bucket shapes.

The state display area 41V1 includes a date and time display area 41*a*, a travel mode display area 41*b*, an attachment display area 41*c*, an engine control status display area 41*e*, an engine operating time display area 41*f*, a coolant water temperature display area 41*g*, a remaining fuel amount display area 41*h*, a rotational speed mode display area 41*i*, a remaining aqueous urea solution amount display area 41*j*, and a hydraulic oil temperature display area 41*k*, in which respective operating information items are displayed. Furthermore, the state display area 41V1 includes a camera image display area 41*m* in which an image captured by the space recognition device 70 is displayed.

The date and time display area 41*a* is an area for displaying a current date and time. According to the example illustrated in FIG. 8, digital display is employed and the date (2014/04/01) and time (10:05) is shown.

The travel mode display area 41*b* is an area for displaying a current travel mode. The travel mode represents the settings of travel hydraulic motors using a variable displacement pump. Specifically, the travel mode includes a low-speed mode and a high-speed mode. A "turtle"-shaped mark is displayed for the low-speed mode, and a "rabbit"-shaped mark is displayed for the high-speed mode. According to the example illustrated in FIG. 8, the "turtle"-shaped mark is displayed to make it possible for the operator to recognize that the low-speed mode is set.

The attachment display area 41*c* is an area for displaying an image representing a currently attached attachment. Various attachments such as a bucket, a rock drill, a grapple, and a lifting magnet are attachable to the shovel 100. For example, marks shaped like these attachments and numbers corresponding to the attachments are displayed in the attachment display area 41*c*. According to the example illustrated in FIG. 8, a rock drill-shaped mark is displayed, and "1" is displayed as a number that represents the magnitude of the output of the rock drill.

The engine control status display area 41*e* is an area for displaying the control status of the engine 11. According to the example illustrated in FIG. 8, the operator can recognize that "automatic deceleration and automatic stop mode" is selected as the control status of the engine 11. The "automatic deceleration and automatic stop mode" means the control status to automatically reduce the engine rotational speed and further to automatically stop the engine in accordance with the duration of the low-load state of the engine 11. Other control statuses of the engine 11 include "automatic deceleration mode," "automatic stop mode," and "manual deceleration mode."

The engine operating time display area 41*f* is an area for displaying the cumulative operating time of the engine 11. According to the example illustrated in FIG. 8, a cumulative operating time since the restart of counting by the operator is displayed together with a unit "hr (hour)." At least one of a lifelong operating time in the entire period after the manufacture of the shovel 100 and a section operating time since the restart of counting by the operator is displayed in the engine operating time display area 41*f*.

The coolant water temperature display area 41*g* is an area for displaying the current temperature condition of engine coolant water. According to the example illustrated in FIG. 8, a bar graph representing the temperature condition of engine coolant water is displayed. The temperature of engine coolant water is displayed based on the output data of a water temperature sensor attached to the engine 11.

The remaining fuel amount display area 41*h* is an area for displaying the status of the remaining amount of fuel stored in a fuel tank. According to the example illustrated in FIG. 8, a bar graph representing the current status of the remaining amount of fuel is displayed. The remaining amount of fuel is displayed based on the output data of a remaining fuel amount sensor.

The rotational speed mode display area 41*i* is an area for displaying a current rotational speed mode set by an engine rotational speed adjustment dial as an image. Examples of rotational speed modes include four modes, namely, SP mode, H mode, A mode, and idling mode. According to the example illustrated in FIG. 8, a symbol "SP" representing SP mode is displayed.

The remaining aqueous urea solution amount display area 41*j* is an area for displaying the status of the remaining amount of an aqueous urea solution stored in an aqueous urea solution tank as an image. According to the example illustrated in FIG. 8, a bar graph representing the current status of the remaining amount of an aqueous urea solution is displayed. The remaining amount of an aqueous urea solution is displayed based on the output data of a remaining aqueous urea solution amount sensor provided in the aqueous urea solution tank.

The hydraulic oil temperature display area 41*k* is an area for displaying the temperature condition of hydraulic oil in the hydraulic oil tank. According to the example illustrated in FIG. 8, a bar graph representing the temperature condition of hydraulic oil is displayed. The temperature of hydraulic oil is displayed based on the output data of an oil temperature sensor.

According to the example illustrated in FIG. 8, the coolant water temperature display area 41*g*, the remaining fuel amount display area 41*h*, the remaining aqueous urea solution amount display area 41*j*, and the hydraulic oil temperature display area 41*k* are provided on the upper side in the state display area 41V1. The coolant water temperature display area 41*g*, the remaining fuel amount display area 41*h*, the remaining aqueous urea solution amount display area 41*j*, and the hydraulic oil temperature display area 41*k*, however, may also be provided to grow or shrink along the circumferential direction of the same single predetermined circle. In this case, the coolant water temperature display area 41*g*, the remaining fuel amount display area 41*h*, the remaining aqueous urea solution amount display area 41*j*, and the hydraulic oil temperature display area 41*k* are placed on the left side, upper side, lower side, and right side, respectively, of the predetermined circle. Furthermore, the coolant water temperature display area 41*g*, the remaining fuel amount display area 41*h*, the remaining aqueous urea solution amount display area 41*j*, and the hydraulic oil temperature display area 41*k* may adopt needle display in lieu of bar graph display.

According to the example illustrated in FIG. 8, the coolant water temperature display area 41*g*, the remaining fuel amount display area 41*h*, the remaining aqueous urea solution amount display area 41*j*, the hydraulic oil temperature display area 41*k*, etc., showing operating information are mainly displayed in an upper area of the state display area 41V1. The display position of the operating information, however, is not limited to this, and the operating information may also be displayed in a left side area or a right side area of the state display area 41V1. The operating information, however, is preferably displayed on the side closer to the operator seat (an upper area according to this embodiment) or a left side area in the state display area 41V1 to be easily checked by the operator.

The camera image display area 41*m* is an area for displaying an image captured by the space recognition device 70. According to the example illustrated in FIG. 8, an image captured by the back sensor 70B is displayed in the camera image display area 41*m*. In the camera image display area 41*m*, however, an image captured by the left sensor 70L or the right sensor 70R may also be displayed. Furthermore, in the camera image display area 41*m*, images captured by two or more of the back sensor 70B, the left sensor 70L, and the right sensor 70R may be displayed side by side. Furthermore, an overhead view image into which images captured by the back sensor 70B, the left sensor 70L, and the right sensor 70R are synthesized may also be displayed in the camera image display area 41*m*.

Each camera is installed such that captured image data include part of the cover 3*a* of the upper swing structure 3. The inclusion of part of the cover 3*a* in the display image allows the operator to have a better sense of distance between an object displayed in the camera image display area 41*m* and the shovel 100.

In the camera image display area 41*m*, an image capturing device icon 41*n* representing the orientation of the space recognition device 70 that has captured an image that is being displayed is displayed. The image capturing device icon 41*n* includes a shovel icon 41*na* representing the shape of the shovel 100 in a plan view and a strip-shaped orientation indicator icon 41*nb* representing the orientation of the space recognition device 70 that has captured the image that is being displayed.

According to the example illustrated in FIG. 8, the orientation indicator icon 41*nb* is displayed below the shovel icon 41*na* (on the opposite side from the attachment), and an image of an area behind the shovel 100 captured by the back sensor 70B is displayed in the camera image display area 41*m*. For example, when an image captured by the right sensor 70R is displayed in the camera image display area 41*m*, the orientation indicator icon 41*nb* is displayed to the right of the shovel icon 41*na*. For example, when an image captured by the left sensor 70L is displayed in the camera image display area 41*m*, the orientation indicator icon 41*nb* is displayed to the left of the shovel icon 41*na*.

Furthermore, in the camera image display area 41*m*, an image GP of a person detected by the space recognition device 70 is displayed, and an image FR that is highlighting centered on the feet of the person represented by the image GP is displayed. According to the example of FIG. 8, the image FR is the image of a frame surrounding the feet of the person represented by the image GP. Furthermore, when the space recognition device 70 detects a predetermined object within a preset area from the shovel 100, the display D1 is used to notify a person engaged in the work of the shovel 100 of the detection of the predetermined object.

The bucket selection area 41V2 includes a bucket shape display area 41*p* and a shape parameters display area 41*q*.

The bucket shape display area 41*p* is an area for displaying a mark shaped like the bucket 6 (hereinafter "bucket image"), which is an example of a bucket shape. The bucket shape display area 41*p* includes, for example, a detection surface that can detect the operator's touch operation. According to the example illustrated in FIG. 8, a bucket image of a normal bucket, a bucket image of a slope bucket, a bucket image of a trenching bucket, and a bucket image of a skeleton bucket are displayed in order from the left. Furthermore, a text representing the type of the bucket 6 (hereinafter referred to as "bucket identification text") may be displayed together with the bucket image in the bucket shape display area 41*p*. According to the example illustrated in FIG. 8, a text "NORMAL" representing a normal bucket is displayed above the bucket image of a normal bucket, and a text "SLOPE" is displayed above the bucket image of a slope bucket. Furthermore, a text "TRENCHING" is displayed above the bucket image of a trenching bucket, and a text "SCKELETON" is displayed above the bucket image of a skeleton bucket. Displaying a text representing the type of the bucket 6 in addition to the bucket image in the bucket shape display area 41*p* in this manner makes it possible for the operator to easily check the type of the bucket 6 and perform touch operation. The number of bucket images and the number of bucket identification texts displayed in the bucket shape display area 41*p* are not limited to four as illustrated in FIG. 8, and may be three or less or five or more. If the number of bucket images and the number of bucket identification texts are large, the bucket images and the bucket identification texts may be displayed in such a manner as to be scrollable in response to the operator's operation.

The shape parameters display area 41*q* is an area for displaying parameters related to the shape of the bucket 6 associated with the bucket image displayed in the bucket shape display area 41*p* (hereinafter referred to as "shape parameters"). According to the example illustrated in FIG. 8, a pin diameter, an arm end width, a bucket width, a pin-teeth tips distance, a pin-back surface distance, and a bucket back surface angle are displayed as the shape parameters. Thus, the shape parameters corresponding to the bucket image are displayed with the bucket image. Therefore, the operator can change the settings at the time of changing buckets while checking the bucket image together with the shape parameters corresponding to the bucket image.

Thus, according to the first example, when the operator selects one of the bucket images displayed in the bucket selection area 41V2, the controller 30 records shape parameters correlated with the selected bucket image as new shape parameters. Therefore, when changing buckets, the operator may select a bucket shape displayed in the bucket selection area 41V2 and does not have to directly input shape parameters (for example, a pin diameter, an arm end width, a bucket width, a pin-teeth tips distance, a pin-back surface distance, and a bucket back surface angle) corresponding to the bucket 6. This facilitates changing settings when changing buckets.

Figure 9:
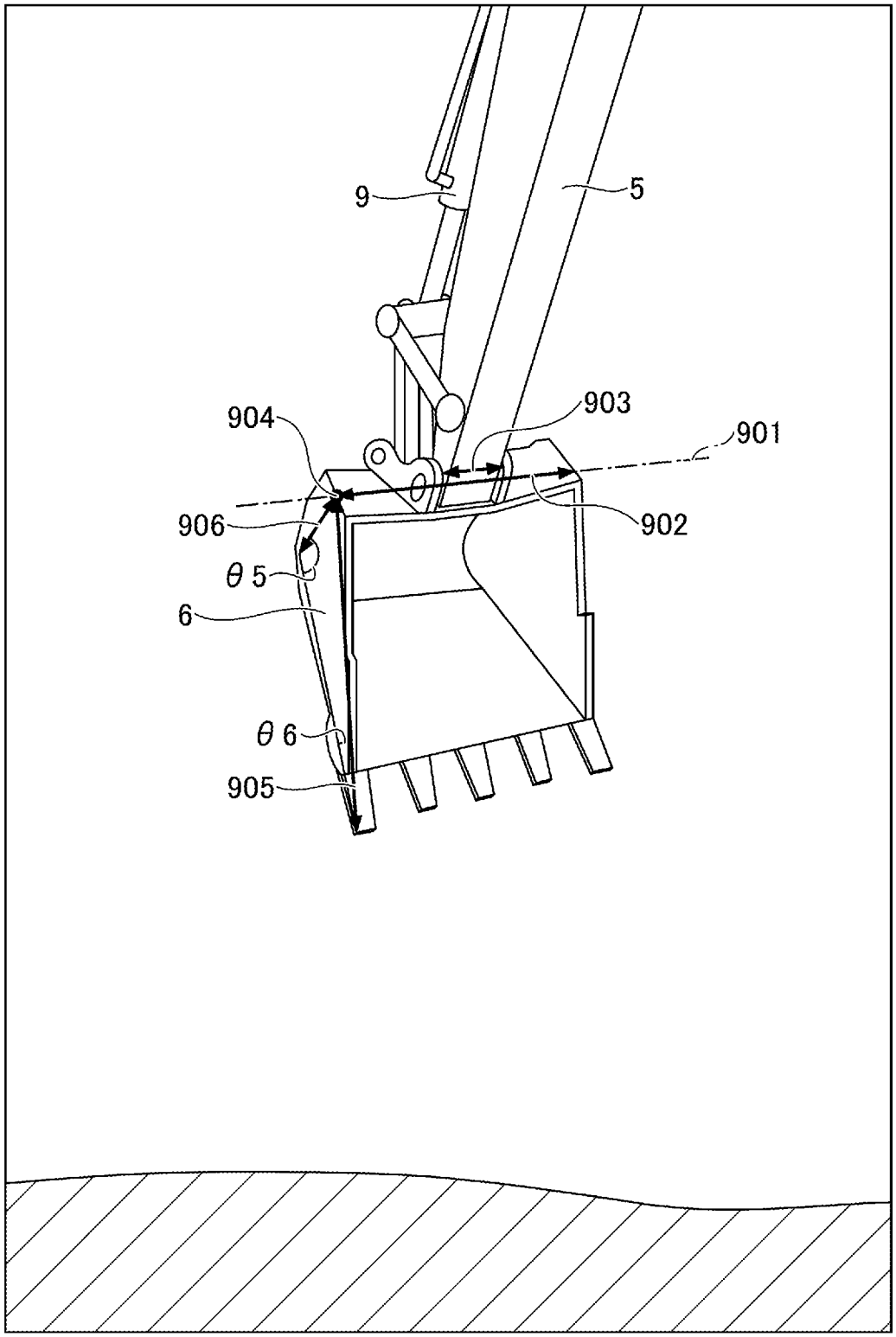
FIG. 9 is a diagram illustrating a bucket image captured with a front sensor.

Next, as a second example of the process of the controller 30 setting the shape parameters of the bucket 6 according to a bucket shape obtained in advance, a process of the controller 30 changing the shape parameters of the bucket 6 according to a bucket image captured by the space recognition device 70 is described with reference to FIG. 9. FIG. 9 is a diagram illustrating a bucket image captured with the front sensor 70F attached to the front end of the upper surface of the cabin 10.

As illustrated in FIG. 9, when an image of an area in front of the shovel 100 is captured with the front sensor 70F, a bucket image including the front and the side of the bucket 6 is obtained.

The controller 30 changes shape parameters based on the bucket image captured with the front sensor 70F and correlation information correlating pre-recorded bucket 6 types and shape parameters. Specifically, the controller 30 identifies the type of the bucket 6 using known image recognition techniques based on the bucket image captured with the front sensor 70F. The controller 30 then obtains shape parameters corresponding to the identified type of the bucket 6 based on the identified type of the bucket 6 and the correlation information correlating the pre-recorded bucket 6 types and shape parameters, and records the obtained shape parameters as new shape parameters.

Thus, according to the second example, when an image of an area in front of the shovel 100 is captured with the front sensor 70F, the controller 30 changes shape parameters based on the captured bucket image and the correlation information correlating the types of the bucket 6 and corresponding shape parameters. Therefore, when changing buckets, the operator may capture an image of an area in front of the shovel 100 including the bucket 6 and does not have to directly input shape parameters corresponding to the bucket 6. This facilitates changing settings when changing buckets.

Next, as a third example of the process of the controller 30 setting the shape parameters of the bucket 6 according to a bucket shape obtained in advance, another process of the controller 30 changing the shape parameters of the bucket 6 according to a bucket image captured by the space recognition device 70 is described with reference to FIG. 9.

As illustrated in FIG. 9, when an image of an area in front of the shovel 100 is captured with the front sensor 70F, a bucket image including the front and the side of the bucket 6 is obtained.

The controller 30 changes shape parameters based on the bucket image captured with the front sensor 70F. Specifically, first, the controller 30 detects a central axis 901 of the bucket link pin. Next, the controller 30 measures a bucket width 902 and an arm end width 903. Next, the controller 30 detects a position 904 of the side of the bucket 6 on the central axis 901 of the bucket link pin. Next, the controller 30 measures a distance 905 from the position 904 of the side of the bucket 6 on the central axis 901 of the bucket link pin to the teeth tips of the bucket 6 and a distance 906 from the position 904 of the side of the bucket 6 on the central axis 901 of the bucket link pin to the back surface of the bucket 6. Next, the controller 30 calculates shape parameters based on the dimension ratio of the measured arm end width 903 and the pre-recorded arm end width of the arm 5 of the shovel 100. For example, the controller 30 calculates the pin-teeth tips distance based on the above-described dimension ratio and the measured distance 905 from the position 904 of the side of the bucket 6 on the central axis 901 of the bucket link pin to the teeth tips of the bucket 6. Furthermore, for example, the controller 30 calculates the pin-back surface distance based on the above-described dimension ratio and the measured distance 906 from the position 904 of the side of the bucket 6 on the central axis 901 of the bucket link pin to the back surface of the bucket 6. Next, the controller 30 records the calculated shape parameters as new shape parameters. Furthermore, the controller 30 may also measure at least one of bucket back surface angles θ5 and θ6 based on the bucket image.

Thus, according to the third example, when an image of an area in front of the shovel 100 is captured with the front sensor 70F, the controller 30 changes shape parameters based on the captured bucket image including the front and the side of the bucket 6. Therefore, when changing buckets, the operator may capture an image of an area in front of the shovel 100 including the front and the side of the bucket 6 using the front sensor 70F and does not have to directly input shape parameters corresponding to the bucket 6. This facilitates changing settings when changing buckets.

Figure 10A:
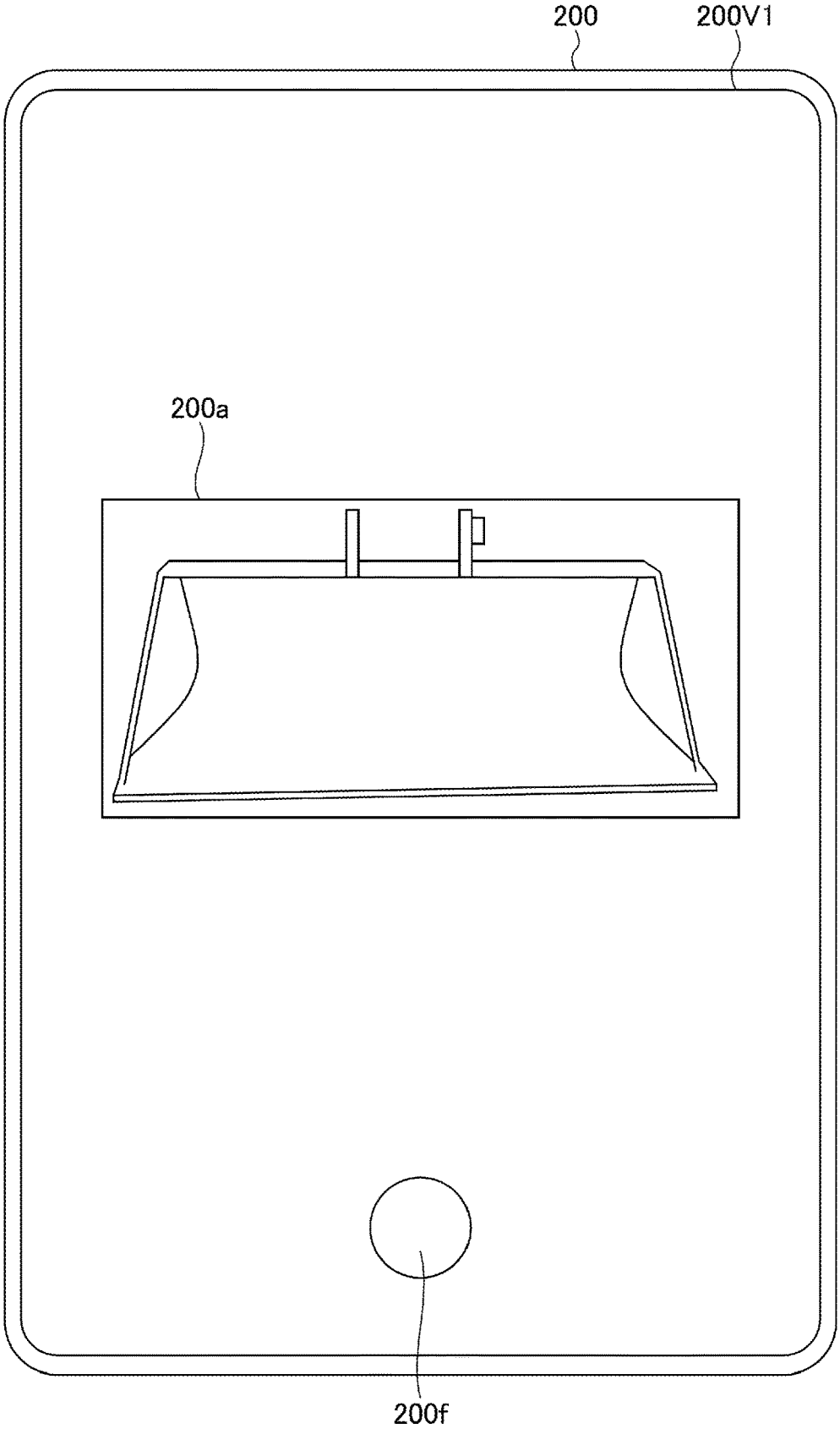
FIG. 10A is a diagram illustrating an example of a screen displayed on a work assist device.
Figure 10B:
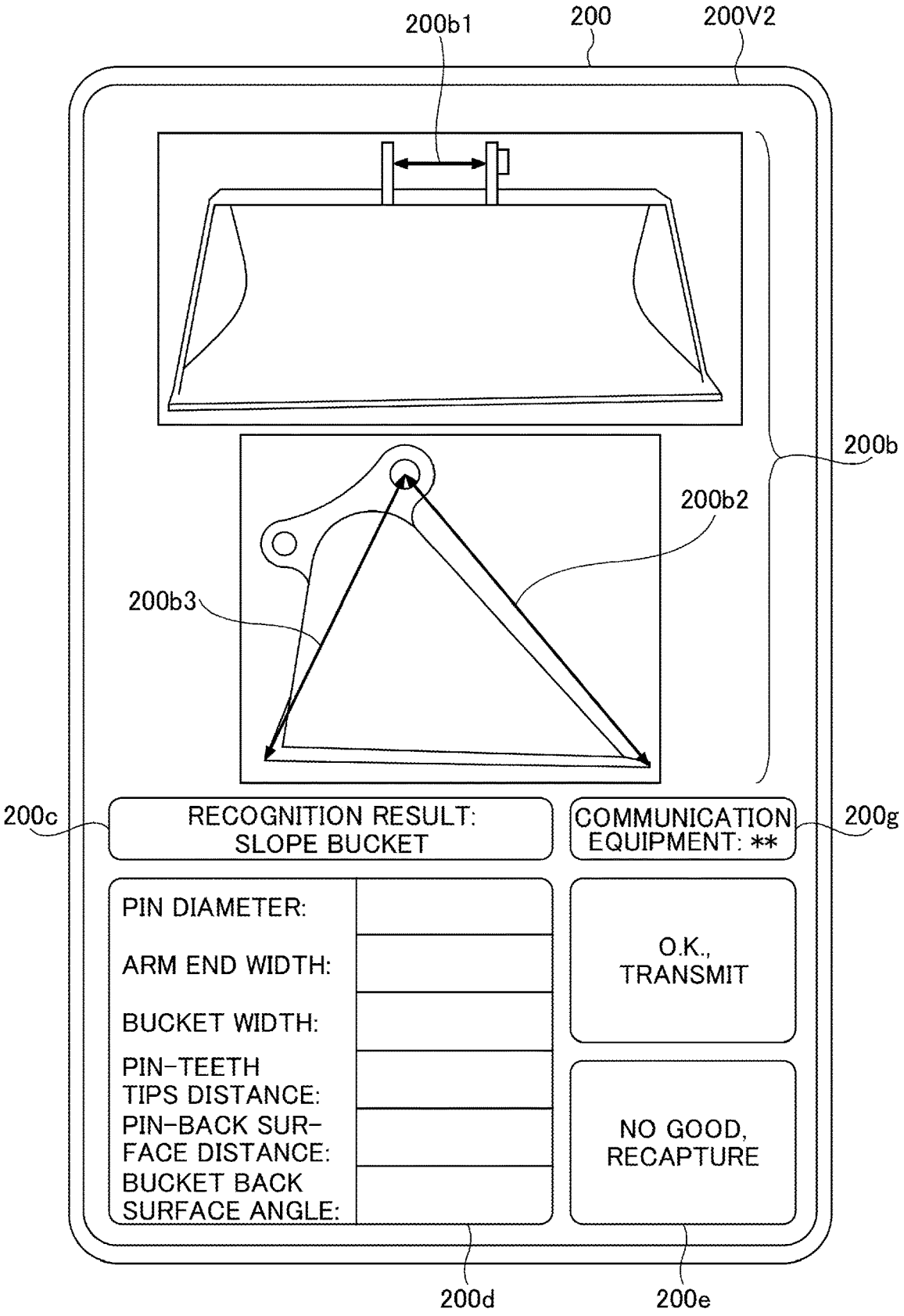
FIG. 10B is a diagram illustrating an example of the screen displayed on the work assist device.

Next, as a fourth example of the process of the controller 30 setting the shape parameters of the bucket 6 according to a bucket shape obtained in advance, a process of the controller 30 changing the shape parameters of the bucket 6 according to a bucket image captured by the work assist device 200 is described with reference to FIGS. 10A and 10B. FIGS. 10A and 10B are diagrams illustrating examples of screens displayed on the work assist device 200. FIG. 10A illustrates an image capturing screen 200V1 at the time of capturing an image of the bucket 6 by the work assist device 200. FIG. 10B illustrates a measurement completion screen 200V2 displaying the shape parameters of the bucket 6 whose image has been captured.

As illustrated in FIG. 10A, the image capturing screen 200V1 includes a camera image display area 200*a*. The work assist device 200 as well is provided with a space recognition device for an assist device. The space recognition device for an assist device is configured to recognize an object present within a three-dimensional space surrounding the work assist device 200, the same as the space recognition device 70 of the shovel 100. Furthermore, the space recognition device for an assist device may also be configured to calculate a distance from the space recognition device for an assist device or the work assist device 200 to the recognized object (for example, the bucket 6). Examples of space recognition devices for an assist device include an ultrasonic sensor, a millimeter wave radar, a monocular camera, a stereo camera, a LIDAR device, a distance image sensor, an infrared sensor, and any combination thereof. Furthermore, an operating part 200*f* used to operate, for example, the space recognition device for an assist device is displayed in the image capturing screen 200V1. According to the example of FIG. 10A, the operating part 200*f* is a shutter icon.

The camera image display area 200*a* is an area for displaying an image captured by the work assist device 200. According to the example illustrated in FIG. 10A, a front image of the bucket 6 captured by the work assist device 200 is displayed in the camera image display area 200*a*.

As illustrated in FIG. 10B, the measurement completion screen 200V2 includes a captured image display area 200*b*, a bucket recognition result display area 200*c*, a shape parameters display area 200*d*, a selection button display area 200*e*, and an equipment identification information display area 200*g*.

The captured image display area 200*b* is an area for displaying an image of the bucket 6 captured by the work assist device 200. According to the example illustrated in FIG. 10B, a front bucket image and a side bucket image of the bucket 6 captured by the work assist device 200 are displayed vertically one above the other in the captured image display area 200*b*. Furthermore, dimension lines that identify the positions of shape parameters displayed in the below-described shape parameters display area 200*d* are displayed over the front bucket image and the side bucket image of the bucket 6 in the captured image display area 200*b*. According to the example illustrated in FIG. 10B, a dimension line 200*b*1 identifying the position of the arm end width is displayed over the front bucket image of the bucket 6 in the captured image display area 200*b*. Furthermore, a dimension line 200*b*2 identifying the pin-teeth tips distance and a dimension line 200*b*3 identifying the pin-back surface distance are displayed over the side bucket image of the bucket 6 in the captured image display area 200*b*.

The bucket recognition result display area 200*c* is an area for displaying the type of the bucket 6 whose image has been captured by the work assist device 200. According to the example illustrated in FIG. 10B, "RECOGNITION RESULT: SLOPE BUCKET" indicating that the type of the bucket 6 is a slope bucket is displayed in the bucket recognition result display area 200*c*. The work assist device 200, for example, identifies the type of the bucket 6 using known image recognition techniques based on the captured front bucket image and side bucket image of the bucket 6. In addition to using a captured image, in the case of using a millimeter wave radar, an ultrasonic sensor, a laser radar, or the like as the space recognition device for an assist device, the space recognition device for an assist device may emit multiple signals (such as laser beams) to an object, receive signals reflected from the object, and detect the distance and the direction of the object from the reflected signals.

The shape parameters display area 200*d* is an area for displaying shape parameters corresponding to the type of the bucket 6 displayed in the bucket recognition result display area 200*c*. According to the example illustrated in FIG. 10B, a pin diameter, an arm end width, a bucket width, a pin-teeth tips distance, a pin-back surface distance, and a bucket back surface angle corresponding to a slope bucket are displayed as shape parameters. Thus, by inputting features related to the shape of the end attachment and automatically recognizing positions to be measured, the dimensions between preset positions are measured. As another measurement method, a worker may tap a captured image on two points to perform measurement. In this case, first, the end positions of a dimension line are recognized by the worker tapping a captured image on two points. The length of the dimension line can be calculated by identifying the dimension line connecting the recognized ends. Thereafter, the shape of the captured image and dimensions are correlated, and the correlation results are transmitted to the shovel 100. As yet another measurement method, dimensions to be measured may be displayed in order with guidance. Specifically, when it is desired to measure the arm end width, by displaying guidance messages such as "STEP 1 (MEAUSRE ARM END WIDTH), PLEASE TAP BOTH ENDS OF ARM END" in sequence, a worker is caused to accurately tap on both ends of the dimension to be measured. As a result, a shape parameter of the bucket 6 can be obtained.

The selection button display area 200*e* is an area for displaying selection buttons for selecting whether to record shape parameters displayed in the shape parameters display area 200*d* as new shape parameters. The selection button display area 200*e* includes, for example, a detection surface that can detect the operator's touch operations. According to the example illustrated in FIG. 10B, a RECORD button and a RECAPTURE button are displayed in the selection button display area 200*e*. The RECORD button is, for example, an "O.K., TRANSMIT" button that indicates that the shape parameters displayed in the shape parameters display area 200*d* are to be recorded as new shape parameters. The RECAPTURE button is, for example, a "NO GOOD, RECAPTURE" button that indicates that an image is to be recaptured without recording the shape parameters displayed in the shape parameters display area 200*d* as new shape parameters. When the operator operates the "O.K., TRANSMIT" button in the selection button display area 200*e*, the work assist device 200 records the shape parameters displayed in the shape parameters display area 200*d* as new shape parameters. When the operator operates the "NO GOOD, RECAPTURE" button in the selection button display area 200*e*, the work assist device 200 displays the image capturing screen 200V1.

The equipment identification information display area 200*g* is an area for displaying information for identifying the work assist device 200, for example, an identification number assigned to the work assist device 200 on a one-to-one basis. According to the example illustrated in FIG. 10B, "COMMUNICATION EQUIPMENT: " indicating that the identification number of the work assist device 200 is "" is displayed in the equipment identification information display area 200*g*.

Thus, according to the fourth example, when images of the front and the side of the bucket 6 of the shovel 100 are captured by the work assist device 200, the work assist device 200 changes shape parameters based on the captured front bucket image and side bucket image of the bucket 6. Therefore, when changing buckets, the operator may capture a front bucket image and a side bucket image of the bucket 6 using the work assist device 200 and does not have to directly input shape parameters corresponding to the bucket 6. This facilitates changing settings when changing buckets.

Figure 11:
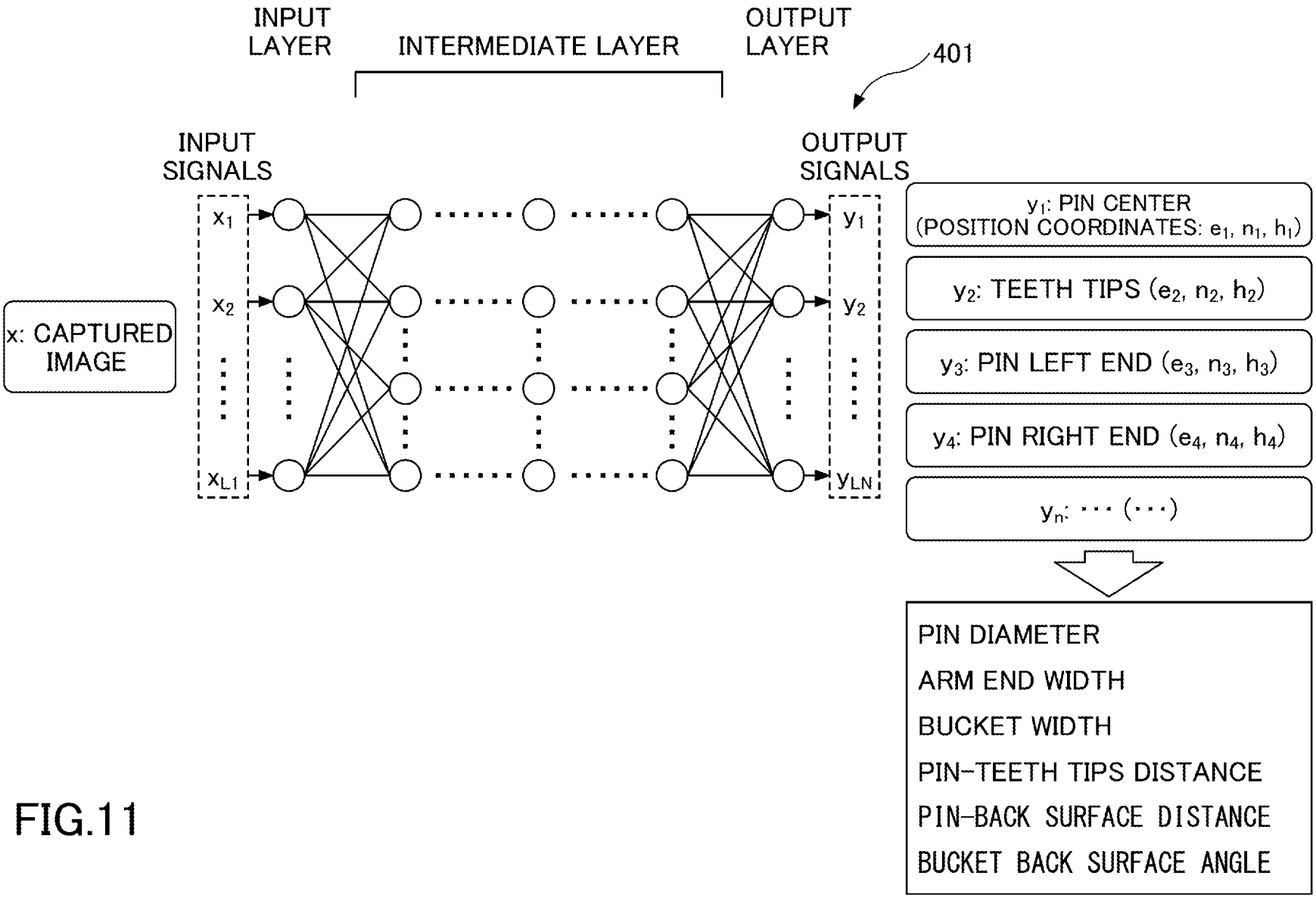
FIG. 11 is a diagram illustrating an example of a process of calculating dimensions of a bucket from a captured image.

Next, as an example of the process of calculating dimensions of the bucket 6 from a captured image, the case of using a learned model is described with reference to FIG. 11. FIG. 11 is a diagram illustrating an example of the process of calculating dimensions of the bucket 6 from a captured image.

The controller 30 calculates dimensions of the bucket 6 based on an image captured by the space recognition device 70, using a machine-learned model LM stored in a non-volatile storage. The captured image may also be an image captured by the space recognition device for an assist device of the work assist device 200.

For example, as illustrated in FIG. 11, the learned model LM is constituted mainly of a neural network 401.

According to this example, the neural network 401 is a so-called deep neural network including one or more intermediate layers (hidden layers) between an input layer and an output layer. According to the neural network 401, a weight parameter that represents the strength of connection with a lower layer is defined with respect to each of the neurons of each intermediate layer. The neural network 401 is configured such that a neuron of each layer outputs the sum of the values obtained by multiplying input values from the upper-layer neurons by their respective defined weight parameters to lower-layer neurons through a threshold function. The management apparatus 300 performs machine learning, specifically, deep learning, on the neural network 401 to optimize the above-described weight parameters.

As a result, for example, as illustrated in FIG. 11, an image captured by the space recognition device 70 is input to the neural network 401 as input signals x, and the neural network 401 can output feature points of the bucket shape (the positions of parts of the bucket 6) detected on the captured image as output signals y. According to this example, the neural network 401 outputs output signals $y_1$ through $y_4$ corresponding to the position of the center of the pin, the position of the teeth tips, the position of the left end of the pin, and the position of the right end of the pin, respectively. The output signal $y_1$ includes east longitude $e_1$, north latitude $n_1$, and altitude $h_1$ as position coordinates. The output signal $y_2$ includes east longitude $e_2$, north latitude $n_2$, and altitude $h_2$ as position coordinates. The output signal $y_3$ includes east longitude $e_3$, north latitude $n_3$, and altitude $h_3$ as position coordinates. The output signal $y_4$ includes east longitude $e_4$, north latitude $n_4$, and altitude $h_4$ as position coordinates. As a result, the controller 30 can calculate the shape parameters of the bucket 6, such as the pin diameter, the arm end width, the bucket width, the pin-teeth tips distance, the pin-back surface distance, and the bucket back surface angle, based on the positions of parts of the bucket 6 output by the neural network 401, namely, the position of the center of the pin, the position of the teeth tips, the position of the left end of the pin, and the position of the right end of the pin, and information on the distance from the space recognition device 70 to the bucket 6 calculated by the space recognition device 70.

The neural network 401 is, for example, a convolutional neural network (CNN). The CNN is a neural network to which existing image processing techniques (convolution and pooling) are applied. Specifically, the CNN repeats a combination of convolution and pooling on an image captured by the space recognition device 70 to extract feature data (a feature map) smaller in size than the captured image. The pixel value of each pixel of the extracted feature map is input to a neural network constituted of fully connected layers, and the output layer of the neural network can output, for example, the positions of parts of the bucket 6 detected on the captured image.

As the learned model LM, aside from the neural network 401, a support vector machine (SVM) or the like may also be applied.

Figure 12:
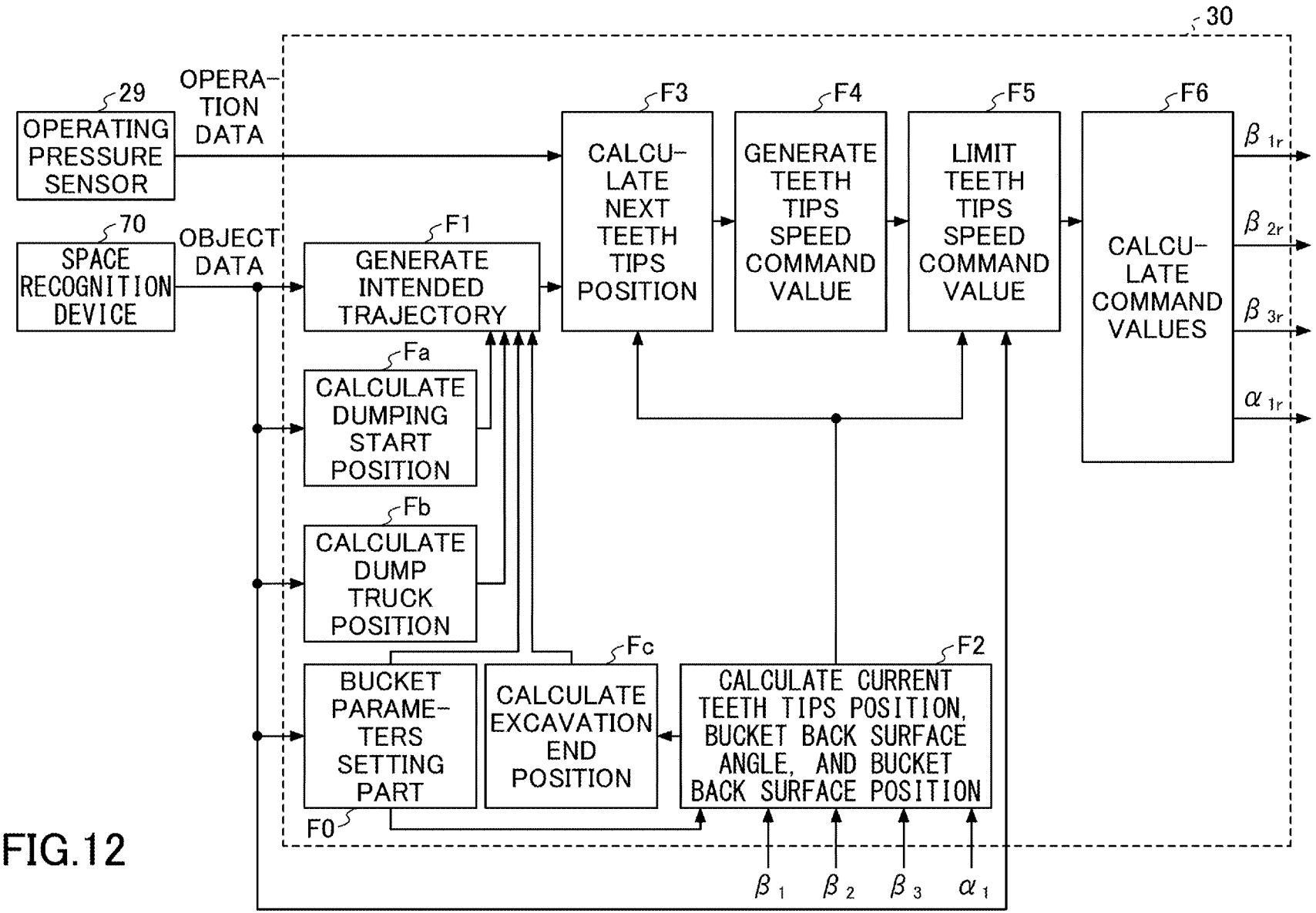
FIG. 12 is a block diagram illustrating an example configuration of an autonomous control function.

Next, an example of the controller 30's function of autonomously controlling the motion of the attachment (hereinafter "autonomous control function") is described with reference to FIGS. 12 and 13. FIG. 12 is a block diagram illustrating an example configuration of the autonomous control function.

The controller 30 includes functional elements Fa through Fc and F0 through F6 associated with execution of autonomous control. The functional elements may be constituted of software, hardware, or a combination of software and hardware.

The functional element Fa is configured to calculate a dumping start position. According to this embodiment, the functional element Fa calculates the position of the bucket 6 at the start of a dumping motion as the dumping start position before the dumping motion is actually started, based on object data output by the space recognition device 70. Specifically, the functional element Fa detects the state of earth already loaded in the bed of a dump truck DT based on the object data output by the space recognition device 70. The state of earth is, for example, on which part of the bed of the dump truck DT the earth is loaded. The functional element Fa then calculates the dumping start position based on the detected state of earth. The functional element Fa may also calculate the dumping start position based on the output of an image capturing device 80. The functional element Fa may also calculate the dumping start position based on the pose of the shovel 100 recorded in a non-volatile storage at the time of a past dumping motion. The functional element Fa may also calculate the dumping start position based on the output of the pose detector. In this case, for example, the functional element Fa may calculate the position of the bucket 6 at the start of a dumping motion as the dumping start position based on the current pose of the excavation attachment AT before the dumping motion is actually performed.

The functional element Fb is configured to calculate a dump truck position. According to this embodiment, the functional element Fb calculates the position of each part of the bed of the dump truck DT as the dump truck position based on the object data output by the space recognition device 70.

The functional element Fc is configured to calculate an excavation end position. According to this embodiment, the functional element FC calculates the position of the bucket 6 at the end of an excavating motion as the excavation end position based on the teeth tips position of the bucket 6 at the end of the latest excavating motion. Specifically, the functional element Fc calculates the excavation end position based on the current teeth tips position of the bucket 6 calculated by the functional element F2 described below. Furthermore, the functional element Fc may use the current bucket back surface angle and bucket back surface position calculated by the functional element F2 described below in calculating the excavation end position.

The functional element F0 is configured to set bucket parameters. According to this embodiment, the functional element F0 sets bucket parameters based on the object data output by the space recognition device 70. The bucket parameters are information on the position of the bucket 6, including, for example, the position of the center of the pin, the position of the teeth tips, the position of the left end of the pin, and the position of the right end of the pin.

The functional element F1 is configured to generate an intended trajectory. According to this embodiment, the functional element F1 generates a trajectory to be followed by the teeth tips of the bucket 6 as an intended trajectory, based on the object data output by the space recognition device 70 and the excavation end position calculated by the functional element Fc. The object data are information on an object present around the shovel 100, including, for example, the position, the shape, etc., of the dump truck DT. Specifically, the functional element F1 calculates the intended trajectory based on the dumping start position calculated by the functional element Fa, the dump truck position calculated by the functional element Fb, and the excavation end position calculated by the functional element Fc. Furthermore, in calculating the target trajectory, the functional element F1 may use the output of the bucket parameters set by the functional element F0.

The functional element F2 is configured to calculate a current teeth tips position. According to this embodiment, the functional element F2 calculates the coordinate point of the teeth tips of the bucket 6 as a current teeth tips position, based on a boom angle $\beta_1$ detected by the boom angle sensor S1, an arm angle $\beta_2$ detected by the arm angle sensor S2, a bucket angle $\beta_3$ detected by the bucket angle sensor S3, and a swing angle $\alpha_1$ detected by the swing angular velocity sensor S5. The functional element F2 may use the output of the machine body tilt sensor S4 in calculating the current teeth tips position. Furthermore, the functional element F2 may also use the output of the functional element F0 in calculating the current teeth tips position. Furthermore, the functional element F2 may also be configured to calculate the bucket back surface angle and the bucket back surface position in addition to the teeth tips position.

The functional element F3 is configured to calculate the next teeth tips position. According to this embodiment, the functional element F3 calculates a teeth tips position after a predetermined time as an intended teeth tips position, based on operation data output by the operating pressure sensor 29, the intended trajectory generated by the functional element F1, and the current teeth tips position calculated by the functional element F2.

The functional element F3 may also determine whether the difference between the current teeth tips position and the intended trajectory falls within an allowable range. According to this embodiment, the functional element F3 determines whether the distance between the current teeth tips position and the intended trajectory is less than or equal to a predetermined value. If the distance is less than or equal to a predetermined value, the functional element F3 determines that the difference is within an allowable range, and calculates the intended teeth tips position. If the distance exceeds the predetermined value, the functional element F3 determines that the difference is not within an allowable range, and decelerates or stops the movement of an actuator irrespective of the amount of lever operation. According to this configuration, the controller 30 can prevent execution of autonomous control from being continued with the teeth tips position being deviated from the intended trajectory.

The functional element F4 is configured to generate a command value with respect to the speed of the teeth tips. According to this embodiment, the functional element F4 calculates the speed of the teeth tips required to move the current teeth tips position to the next teeth tips position in a predetermined time as a command value with respect to the speed of the teeth tips, based on the current teeth tips position calculated by the functional element F2 and the next teeth tips position calculated by the functional element F3.

The functional element F5 is configured to limit the command value with respect to the speed of the teeth tips. According to this embodiment, the functional element F5 limits the command value with respect to the speed of the teeth tips to a predetermined upper limit value in response to determining that the distance between the teeth tips and the dump truck DT is less than a predetermined value based on the current teeth tips position calculated by the functional element F2 and the output of the space recognition device 70. Thus, the controller 30 reduces the speed of the teeth tips when the teeth tips approach the dump truck DT.

The functional element F6 is configured to calculate command values for operating actuators. According to this embodiment, to move the current teeth tips position to the intended teeth tips position, the functional element F6 calculates a command value $\beta_{1r}$ with respect to the boom angle $\beta_1$, a command value $\beta_{2r}$ with respect to the arm angle $\beta_2$, a command value $\beta_{3r}$ with respect to the bucket angle $\beta_3$, and a command value $\alpha_{1r}$ with respect to the swing angle $\alpha_1$, based on the intended teeth tips position calculated by the functional element F3. The functional element F6 calculates the command value $\beta_{1r}$ as needed even when the boom 4 is not operated. This is for automatically moving the boom 4. The same is the case with the arm 5, the bucket 6, and the swing mechanism 2.

Next, the functional element F6 is described in detail with reference to FIG. 13. FIG. 13 is a block diagram illustrating an example configuration of the functional element F6 that calculates various command values.

Figure 13:
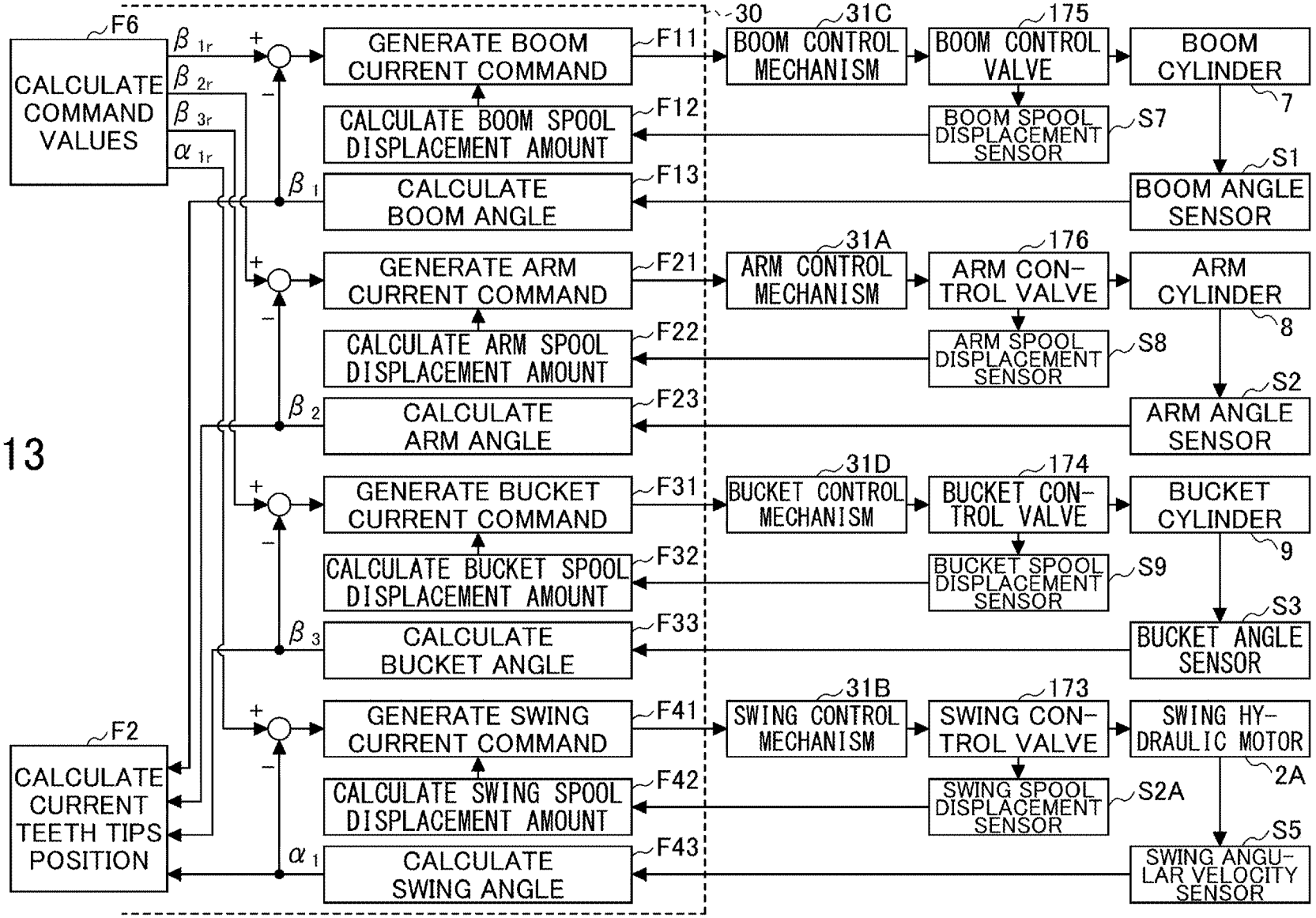
FIG. 13 is a block diagram illustrating an example configuration of the autonomous control function.

As illustrated in FIG. 13, the controller 30 further includes functional elements F11 through F13, F21 through F23, F31 through F33, and F41 through F43 associated with generation of command values. The functional elements may be constituted of software, hardware, or a combination of software and hardware.

The functional elements F11 through F13 are functional elements related to the command value $\beta_{1r}$. The functional elements F21 through F23 are functional elements related to the command value $\beta_{2r}$. The functional elements F31 through F33 are functional elements related to the command value $\beta_{3r}$. The functional elements F41 through F43 are functional elements related to the command value $\alpha_{1r}$.

The functional elements F11, F21, F31 and F41 are configured to generate a current command to be output to the proportional valve 31. According to this embodiment, the functional element F11 outputs a boom current command to a boom control mechanism 31C. The functional element F21 outputs an arm current command to an arm control mechanism 31A. The functional element F31 outputs a bucket current command to a bucket control mechanism 31D. The functional element F41 outputs a swing current command to a swing control mechanism 31B.

The bucket control mechanism 31D is configured to be able to cause a pilot pressure commensurate with a control current corresponding to a bucket cylinder pilot pressure command to act on the control valve 174 serving as a bucket control valve. The bucket control mechanism 31D may be, for example, the proportional valve 31CL and the proportional valve 31CR in FIG. 6C.

The functional elements F12, F22, F32 and F42 is configured to calculate the amount of displacement of a spool that is a constituent part of a spool valve. According to this embodiment, the functional element F12 calculate the amount of displacement of a boom spool that is a constituent part of the control valve 175 associated with the boom cylinder 7, based on the output of a boom spool displacement sensor S7. The functional element F22 calculate the amount of displacement of an arm spool that is a constituent part of the control valve 176 associated with the arm cylinder 8, based on the output of an arm spool displacement sensor S8. The functional element F32 calculate the amount of displacement of a bucket spool that is a constituent part of the control valve 174 associated with the bucket cylinder 9, based on the output of a bucket spool displacement sensor S9. The functional element F42 calculate the amount of displacement of a swing spool that is a constituent part of the control valve 173 associated with the swing hydraulic motor 2A, based on the output of a swing spool displacement sensor S2A. The bucket spool displacement sensor S9 is a sensor that detects the amount of displacement of the spool of the control valve 174.

The functional elements F13, F23, F33 and F43 are configured to calculate the pivot angle of a working body. According to this embodiment, the functional element F13 calculates the boom angle $\beta_1$ based on the output of the boom angle sensor S1. The functional element F23 calculates the arm angle $\beta_2$ based on the output of the arm angle sensor S2. The functional element F33 calculates the bucket angle $\beta_3$ based on the output of the bucket angle sensor S3.

The functional element F43 calculates the swing angle $\alpha_1$ based on the output of the swing angular velocity sensor S5.

Specifically, the functional element F11 basically generates such a boom current command to the boom control mechanism 31C as to eliminate the difference between the command value $\beta_{1r}$ generated by the functional element F6 and the boom angle $\beta_1$ calculated by the functional element F13. At this point, the functional element F11 controls the boom current command to eliminate the difference between the intended amount of displacement of the boom spool derived from the boom current command and the amount of displacement of the boom spool calculated by the functional element F12. The functional element F11 then outputs the controlled boom current command to the boom control mechanism 31C.

The boom control mechanism 31C changes its opening area according to the boom current command to cause a pilot pressure commensurate with the size of the opening area to act on a pilot port of the control valve 175. The control valve 175 moves the boom spool according to the pilot pressure to cause hydraulic oil to flow into the boom cylinder 7. The boom spool displacement sensor S7 detects the displacement of the boom spool and feeds the detection result back to the functional element F12 of the controller 30. The boom cylinder 7 extends or retracts according to the inflow of hydraulic oil to move up or down the boom 4. The boom angle sensor S1 detects the pivot angle of the boom 4 moving up or down, and feeds the detection result back to the functional element F13 of the controller 30. The functional element F13 feeds the calculated boom angle $\beta_1$ back to the functional element F2.

The functional element F21 basically generates such an arm current command to the arm control mechanism 31A as to eliminate the difference between the command value $\beta 2r$ generated by the functional element F6 and the arm angle $\beta_2$ calculated by the functional element F23. At this point, the functional element F21 controls the arm current command to eliminate the difference between the intended amount of displacement of the arm spool derived from the arm current command and the amount of displacement of the boom spool calculated by the functional element F22. The functional element F21 then outputs the controlled arm current command to the arm control mechanism 31A.

The arm control mechanism 31A changes its opening area according to the arm current command to cause a pilot pressure commensurate with the size of the opening area to act on a pilot port of the control valve 176. The control valve 176 moves the arm spool according to the pilot pressure to cause hydraulic oil to flow into the arm cylinder 8. The arm spool displacement sensor S8 detects the displacement of the arm spool and feeds the detection result back to the functional element F22 of the controller 30. The arm cylinder 8 extends or retracts according to the inflow of hydraulic oil to close or open the arm 5. The arm angle sensor S2 detects the pivot angle of the opening or closing arm 5, and feeds the detection result back to the functional element F23 of the controller 30. The functional element F23 feeds the calculated arm angle $\beta_2$ back to the functional element F2.

The functional element F31 basically generates such a bucket current command to the bucket control mechanism 31D as to eliminate the difference between the command value $\beta_{3r}$ generated by the functional element F6 and the bucket angle $\beta_3$ calculated by the functional element F33. At this point, the functional element F31 controls the bucket current command to eliminate the difference between the intended amount of displacement of the bucket spool derived from the bucket current command and the amount of displacement of the bucket spool calculated by the functional element F32. The functional element F31 then outputs the controlled bucket current command to the bucket control mechanism 31D.

The bucket control mechanism 31D changes its opening area according to the bucket current command to cause a pilot pressure commensurate with the size of the opening area to act on a pilot port of the control valve 174. The control valve 174 moves the bucket spool according to the pilot pressure to cause hydraulic oil to flow into the bucket cylinder 9. The bucket spool displacement sensor S9 detects the displacement of the bucket spool and feeds the detection result back to the functional element F32 of the controller 30. The bucket cylinder 9 extends or retracts according to the inflow of hydraulic oil to close or open the bucket 6. The bucket angle sensor S3 detects the pivot angle of the opening or closing bucket 6, and feeds the detection result back to the functional element F33 of the controller 30. The functional element F33 feeds the calculated bucket angle $\beta_3$ back to the functional element F2.

The functional element F41 basically generates such a swing current command to the swing control mechanism 31B as to eliminate the difference between the command value $\alpha_{1r}$ generated by the functional element F6 and the swing angle $\alpha_1$ calculated by the functional element F43. At this point, the functional element F41 controls the swing current command to eliminate the difference between the intended amount of displacement of the swing spool derived from the swing current command and the amount of displacement of the swing spool calculated by the functional element F42. The functional element F41 then outputs the controlled swing current command to the swing control mechanism 31B.

The swing control mechanism 31B changes its opening area according to the swing current command to cause a pilot pressure commensurate with the size of the opening area to act on a pilot port of the control valve 173. The control valve 173 moves the swing spool according to the pilot pressure to cause hydraulic oil to flow into the swing hydraulic motor 2A. The swing spool displacement sensor S2A detects the displacement of the swing spool and feeds the detection result back to the functional element F42 of the controller 30. The swing hydraulic motor 2A rotates according to the inflow of hydraulic oil to swing the upper swing structure 3. The swing angular velocity sensor S5 detects the swing angle of the upper swing structure 3, and feeds the detection result back to the functional element F43 of the controller 30. The functional element F43 feeds the calculated swing angle $\alpha_1$ back to the functional element F2.

Thus, the controller 30 builds a three-stage feedback loop with respect to each working body. That is, the controller 30 builds a feedback loop with respect to the amount of spool displacement, a feedback loop with respect to the pivot angle of a working body, and a feedback loop with respect to the teeth tips position. Therefore, the controller 30 can control the movement of the teeth tips of the bucket 6 with high accuracy during autonomous control.

Figure 14:
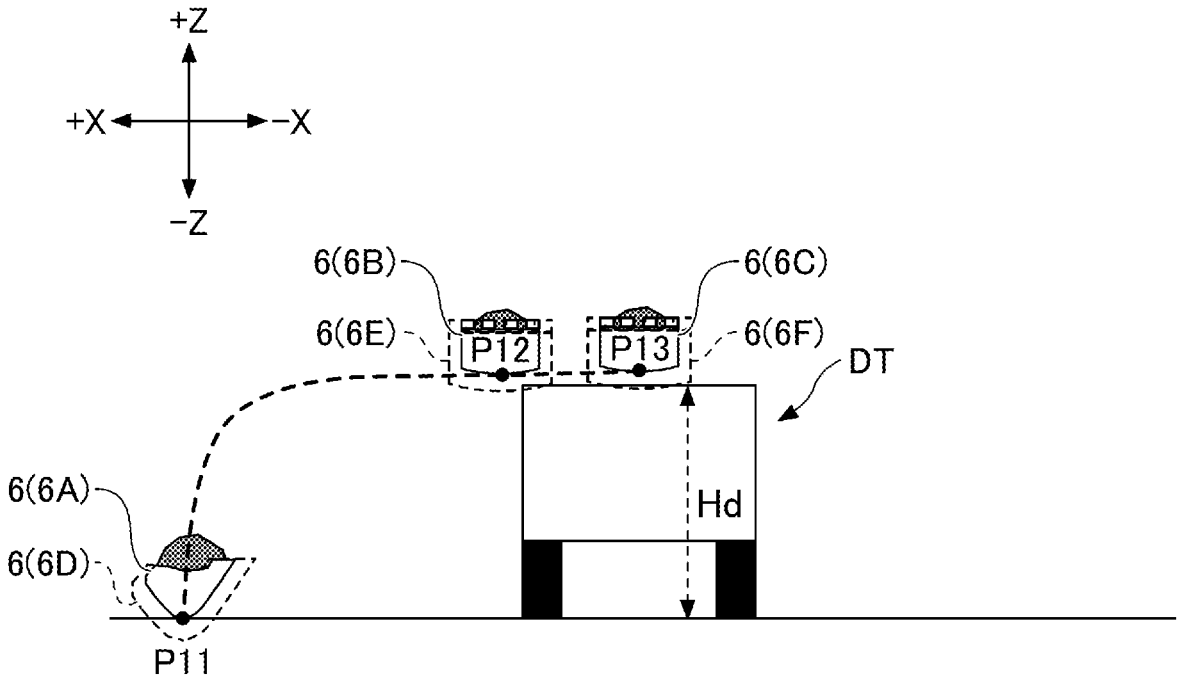
FIG. 14 is a diagram illustrating an example situation in a worksite.

Next, an example situation in a worksite where the shovel 100 is loading the dump truck DT with earth or the like is described with reference to FIG. 14. FIG. 14 illustrates an example situation in a worksite where the shovel 100 is loading the dump truck DT with earth or the like. Specifically, FIG. 14 is a view of the worksite as seen from the back side of the dump truck DT. In FIG. 14, the graphical representation of the shovel 100 (except for the bucket 6) is omitted for clarification. Furthermore, in FIG. 14, buckets 6A, 6B and 6C drawn with a solid line represent the state of the bucket 6 at the end of an excavating motion, the state of the bucket 6 during a complex motion, and the state of the bucket 6 before the start of a dumping motion, respectively. Furthermore, the thick dashed line in FIG. 14 represents a trajectory drawn by a predetermined point on the back surface of the bucket 6.

When the operating device 26 is operated with the switch NS being pressed by the operator at the end of an excavating motion, the controller 30 autonomously operates the shovel 100 so that a predetermined part of the attachment, for example, the predetermined point on the back surface of the bucket 6, moves along an intended trajectory. As a result, the predetermined point on the back surface of the bucket 6 moves in order from Position P11 where the excavating motion has ended, to Position P12 during a complex motion, and to Position P13 before the start of a dumping motion, performing the loading of earth or the like (boom raising and swinging).

In this case, if the bucket 6 has been changed without changing its shape parameters, the predetermined point on the back surface of the bucket 6 moves off the intended trajectory as indicated by buckets 6D, 6E and 6F drawn with a dashed line in FIG. 14, so that the back surface of the bucket 6 may contact a gate or the like of the dump truck DT.

In contrast, according to this embodiment, the controller 30 sets the shape parameters of the bucket 6 according to the bucket shape obtained in advance, and moves the bucket 6 along an intended trajectory derived based on the set shape parameters of the bucket 6. Therefore, even when the bucket 6 is changed, the back surface of the bucket 6 is prevented from contacting a gate or the like of the dump truck DT.

Furthermore, when moving the bucket 6 along the intended trajectory, the controller 30 may, for example, use the space recognition device 70 to perform monitoring to prevent the back surface of the bucket 6 from contacting a gate or the like of the dump truck DT.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although an embodiment of the invention is described in detail above, it should be understood that various changes, substitutions, and alterations could be made hereto without departing from the spirit and scope of the invention.

For example, according to the above-described embodiment, the case where the controller 30 of the shovel 100 sets the shape parameters of the bucket 6 according to the bucket shape obtained in advance and derives (generates) an intended trajectory based on the set shape parameters of the bucket 6 is illustrated by way of example. The present disclosure, however, is not limited to this. For example, the management apparatus 300 may set the shape parameters of the bucket 6 according to the bucket shape obtained in advance and generate an intended trajectory based on the set shape parameters of the bucket 6.

What is claimed is:

1. A shovel comprising:

a lower traveling structure;

an upper swing structure swingably mounted on the lower traveling structure;

an attachment including a boom attached to the upper swing structure, an arm attached to the boom, and a bucket attached to the arm; and processing circuitry configured to set a plurality of shape parameters of the bucket according to a bucket shape obtained in advance, the bucket shape representing a shape of the bucket, the plurality of shape parameters including a pin diameter, an arm end width, a bucket width, a pin-teeth tips distance, a pin-back surface distance, and a bucket back surface angle, generate an intended trajectory to be followed by a predetermined part of the bucket using the set plurality of shape parameters of the bucket, the intended trajectory being a trajectory from a position of the predetermined part of the bucket at an end of an excavating motion to a position of the predetermined part of the bucket before a start of a dumping motion to be followed by the predetermined part of the bucket during a motion of raising the boom and swinging the upper swing structure, and move the predetermined part of the bucket along the generated intended trajectory.

2. The shovel as claimed in claim 1, wherein the bucket shape includes a bucket image displayed on a display, the bucket image representing the shape of the bucket, and the processing circuitry is configured to input the plurality of shape parameters based on the bucket image displayed on the display.

3. The shovel as claimed in claim 1, wherein the bucket shape includes a bucket image captured by an image capturing device, and the processing circuitry is configured to change the plurality of shape parameters based on the bucket image captured by the image capturing device.

4. The shovel as claimed in claim 3, wherein the processing circuitry is configured to change the plurality of shape parameters based on the bucket image captured by the image capturing device and on correlation information correlating pre-recorded bucket types and corresponding shape parameters.

5. The shovel as claimed in claim 3, wherein the processing circuitry is configured to calculate a dimension of the bucket based on the bucket image captured by the image capturing device and on information on a distance from the image capturing device to the bucket.

6. The shovel as claimed in claim 3, wherein the image capturing device is attached to the shovel.

7. The shovel as claimed in claim 1, wherein the bucket shape includes a bucket image captured by an image capturing device, and the image capturing device is a portable terminal.

8. The shovel as claimed in claim 7, wherein the image capturing device is configured to calculate a dimension of the bucket based on the captured bucket image and on information on a distance to the bucket.

9. The shovel as claimed in claim 8, wherein the image capturing device is configured to select a plurality of feature points of the bucket shape from the captured bucket image and to calculate a dimension between the feature points of the bucket shape based on the feature points of the bucket shape and the information on the distance to the bucket.

10. A shovel management apparatus configured to manage a shovel, the shovel including a lower traveling structure, an upper swing structure swingably mounted on the lower traveling structure, and an attachment including a boom attached to the upper swing structure, an arm attached to the boom, and a bucket attached to the arm, the shovel management apparatus comprising:

processing circuitry configured to set a plurality of shape parameters of the bucket according to a bucket shape obtained in advance, the bucket shape representing a shape of the bucket, the plurality of shape parameters including a pin diameter, an arm end width, a bucket width, a pin-teeth tips distance, a pin-back surface distance, and a bucket back surface angle, and generate an intended trajectory to be followed by a predetermined part of the bucket using the set plurality of shape parameters of the bucket, the intended trajectory being a trajectory from a position of the predetermined part of the bucket at an end of an excavating motion to a position of the predetermined part of the bucket before a start of a dumping motion to be followed by the predetermined part of the bucket during a motion of raising the boom and swinging the upper swing structure, such that the shovel moves the predetermined part of the bucket along the generated intended trajectory.

11. The shovel management apparatus as claimed in claim 10, wherein the plurality of shape parameters of the bucket are calculated based on the bucket shape obtained by an image capturing device.

12. The shovel management apparatus as claimed in claim 11, wherein the image capturing device is a portable terminal.

13. The shovel as claimed in claim 1, wherein the processing circuitry is further configured to display a plurality of selectable images of buckets and at least one shape parameter associated with each of the plurality of selectable images on a display, and record the at least one shape parameter associated with an image selected from the plurality of selectable images on the display as a new shape parameter.

14. The shovel as claimed in claim 1, wherein the processing circuitry is configured to generate the intended trajectory to be followed by the predetermined part of the bucket when the shovel autonomously operates, based on the set plurality of shape parameters of the bucket.

15. The shovel as claimed in claim 1, wherein the hardware processor is configured to move the predetermined part of the bucket along the generated intended trajectory from the position of the predetermined part of the bucket at the end of the excavating motion to the position of the predetermined part of the bucket before the start of the dumping motion while the lower traveling structure is stationary.

* * * * *